US011643935B2

(12) United States Patent
Miyahisa et al.

(10) Patent No.: US 11,643,935 B2
(45) Date of Patent: May 9, 2023

(54) TURBINE BLADE AND GAS TURBINE

(71) Applicant: Mitsubishi Hitachi Power Systems, Ltd., Yokohama (JP)

(72) Inventors: Yasuo Miyahisa, Yokohama (JP); Susumu Wakazono, Yokohama (JP); Satoshi Hada, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 77 days.

(21) Appl. No.: 16/651,559

(22) PCT Filed: Oct. 15, 2018

(86) PCT No.: PCT/JP2018/038335
§ 371 (c)(1),
(2) Date: Mar. 27, 2020

(87) PCT Pub. No.: WO2019/093075
PCT Pub. Date: May 16, 2019

(65) Prior Publication Data

US 2020/0263554 A1 Aug. 20, 2020

(30) Foreign Application Priority Data

Nov. 9, 2017 (JP) ..... JP2017-216759

(51) Int. Cl.
*F01D 5/18* (2006.01)
*F01D 9/06* (2006.01)

(52) U.S. Cl.
CPC ..... *F01D 5/188* (2013.01); *F01D 9/065* (2013.01); *F05D 2250/185* (2013.01); *F05D 2260/231* (2013.01)

(58) Field of Classification Search
CPC ..... F01D 5/186; F01D 5/187; F01D 5/188; F01D 5/189; F01D 9/065; F05D 2250/185; F05D 2260/231
See application file for complete search history.

(56) References Cited

U.S. PATENT DOCUMENTS 4,180,373 A * 12/1979 Moore ..... F01D 5/187 415/115
5,695,321 A * 12/1997 Kercher ..... F01D 5/187 416/97 R (Continued)

FOREIGN PATENT DOCUMENTS

DE 602 20 875 2/2008
JP 10-252405 9/1998

(Continued)

OTHER PUBLICATIONS

International Search Report dated Dec. 25, 2018 in corresponding International (PCT) Application No. PCT/JP2018/038335.

(Continued)

*Primary Examiner* — Richard A Edgar
*Assistant Examiner* — Michael K. Reitz
(74) *Attorney, Agent, or Firm* — Wenderoth, Lind & Ponack, L.L.P.

(57) ABSTRACT

A turbine blade includes an airfoil body, and a plurality of cooling passages extending along a blade height direction inside the airfoil body and being in communication with each other to define a serpentine flow passage. The plurality of cooling passages include first turbulators on an inner wall surface of an upstream cooling passage of the plurality of cooling passages, and second turbulators on an inner wall surface of a downstream cooling passage of the plurality of cooling passages. A second angle formed by the second turbulators with respect to a flow direction of a cooling fluid in the downstream cooling passage is smaller than a first (Continued)

angle formed by the first turbulators with respect to the flow direction of the cooling fluid in the upstream cooling passage.

11 Claims, 14 Drawing Sheets

(56) References Cited

U.S. PATENT DOCUMENTS

| | | | | |
|---|---|---|---|---|
| 5,975,850 | A | 11/1999 | Abuaf et al. | |
| 6,077,034 | A | 6/2000 | Tomita et al. | |
| 6,089,826 | A * | 7/2000 | Tomita | F01D 5/187 415/115 |
| 6,227,804 | B1 | 5/2001 | Koga et al. | |
| 8,210,814 | B2 * | 7/2012 | Zausner | F01D 5/187 416/97 R |
| 8,556,583 | B2 * | 10/2013 | Fujimura | F01D 5/187 416/92 |
| 9,995,146 | B2 * | 6/2018 | Benson | F01D 5/187 |
| 2001/0018024 | A1 | 8/2001 | Hyde et al. | |
| 2003/0108422 | A1 | 6/2003 | Merry | |
| 2009/0041587 | A1 | 2/2009 | Konter et al. | |
| 2009/0068023 | A1 | 3/2009 | Liang | |
| 2011/0044822 | A1 * | 2/2011 | Hada | F01D 5/187 416/97 R |
| 2013/0045111 | A1 * | 2/2013 | Lee | F01D 5/187 416/97 R |
| 2014/0086756 | A1 * | 3/2014 | Papple | F01D 5/187 416/95 |
| 2015/0322798 | A1 | 11/2015 | Bauer et al. | |

FOREIGN PATENT DOCUMENTS

| | | |
|---|---|---|
| JP | 10-252410 | 9/1998 |
| JP | 11-229806 | 8/1999 |
| JP | 11-241602 | 9/1999 |
| JP | 2000-314301 | 11/2000 |
| JP | 2001-137958 | 5/2001 |
| JP | 2002-242607 | 8/2002 |
| JP | 2003-193805 | 7/2003 |
| JP | 2003-278501 | 10/2003 |
| JP | 2004-137958 | 5/2004 |
| JP | 2015-214979 | 12/2015 |

OTHER PUBLICATIONS

International Preliminary Report on Patentability dated May 22, 2020 in corresponding International (PCT) Application No. PCT/JP2018/038335, with English Translation.

Office Action dated May 5, 2022 in German Patent Application No. 11 2018 004 279.0.

* cited by examiner

TURBINE BLADE AND GAS TURBINE

TECHNICAL FIELD

The present disclosure relates to a turbine blade and a gas turbine.

BACKGROUND

It is known that, in a turbine blade for a gas turbine or the like, the turbine blade exposed to a high-temperature gas flow or the like is cooled by flowing a cooling fluid to a cooling passage formed inside the turbine blade.

For example, Patent Documents 1 to 3 each disclose a turbine blade having an airfoil portion inside of which a serpentine flow passage is formed by a plurality of cooling passages extending along a blade height direction. Rib-shaped turbulators are provided on inner wall surfaces of the cooling passages in the turbine blade. The turbulators are provided in order to improve a heat-transfer coefficient between the cooling fluid and the turbine blade by promoting turbulence in the flow of the cooling fluid in the cooling passages.

In addition, Patent Document 3 describes that the turbulators are provided such that an inclination angle formed between each of the turbulator (rib) and the direction of a cooling flow in each of the cooling passages is substantially constant.

CITATION LIST

Patent Literature

Patent Document 1: JPH11-229806A
Patent Document 2: JP2004-137958A
Patent Document 3: JP2015-214979A

SUMMARY

Technical Problem

However, depending on the shape or an operation state of a turbine blade, the selection of a turbulator having a high heat-transfer coefficient and high cooling performance may rather have a negative effect on the performance of the turbine blade.

Thus, an object of at least one embodiment of the present invention is to provide a turbine blade and a gas turbine capable of efficiently cooling a turbine by selecting an appropriate turbulator.

Solution to Problem (1) A turbine blade according to at least one embodiment of the present invention includes an airfoil body, and a plurality of cooling passages extending along a blade height direction inside the airfoil body and communicating with each other to form a serpentine flow passage. The cooling passages include first turbulators disposed on an inner wall surface of an upstream side passage of the plurality of cooling passages, and second turbulators disposed on an inner wall surface of a downstream side passage of the plurality of cooling passages, the second turbulators being arranged on a downstream side of the upstream side passage. A second angle formed by the second turbulators with respect to a flow direction of a cooling fluid in the most downstream passage is smaller than a first angle formed by the first turbulators with respect to the flow direction of the cooling fluid in the upstream side passage.

(1') Alternatively, a turbine blade according to at least one embodiment of the present invention includes an airfoil body, a plurality of cooling passages extending along a blade height direction inside the airfoil body and communicating with each other to form a serpentine flow passage, rib-shaped first turbulators disposed on an inner wall surface of an upstream side passage of the plurality of cooling passages, and rib-shaped second turbulators disposed on an inner wall surface of a downstream side passage of the plurality of cooling passages, the rib-shaped second turbulators being arranged on a downstream side of the upstream side passage. A second angle formed by the second turbulators with respect to a flow direction of a cooling fluid in the most downstream passage is smaller than a first angle formed by the first turbulators with respect to the flow direction of the cooling fluid in the upstream side passage.

In the cooling passages, in a range where an angle formed by the turbulators with respect to the flow direction of the cooling fluid (may also be referred to as an "inclination angle" hereinafter) is in the vicinity of 90 degrees, the heat-transfer coefficient between the cooling fluid and the turbine blade tends to high as the inclination angle is small.

In this regard, with the above configuration (1), the inclination angle (second angle) of the second turbulators in the most downstream passage is smaller than the inclination angle (first angle) of the first turbulators in the upstream side passage of the serpentine flow passage. Thus, the above-described heat-transfer coefficient is relatively low in the upstream side passage, and cooling of the turbine blade is suppressed, making it possible to maintain the temperature of the cooling fluid from the upstream side passage toward the downstream side passage relatively low, and the above-described heat-transfer coefficient is relatively high in the downstream side passage, and cooling of the turbine blade is promoted, making it possible to enhance cooling of the turbine blade in a downstream side region of the serpentine flow passage. Thus, it is possible to reduce the amount of the cooling fluid supplied to the serpentine flow passage to cool the turbine blade, making it possible to improve thermal efficiency of the turbine including the gas turbine and the like.

(2) In some embodiments, in the above configuration (1), a second shape factor defined by a height and a pitch of the second turbulators with respect to the flow direction of the cooling fluid in the downstream side passage is smaller than a first shape factor defined by a height and a pitch of the first turbulators with respect to the flow direction of the cooling fluid in the upstream side passage.

(3) A turbine blade according to at least one embodiment of the present invention includes an airfoil body, and a plurality of cooling passages extending along a blade height direction inside the airfoil body and communicating with each other to form a serpentine flow passage. The cooling passages include first turbulators disposed on an inner wall surface of an upstream side passage of the plurality of cooling passages, and second turbulators disposed on an inner wall surface of a downstream side passage of the plurality of cooling passages, the second turbulators communicating with the upstream side passage and being positioned on a downstream side of the upstream side passage. A second shape factor defined by a height and a pitch of the second turbulators with respect to a flow direction of a cooling fluid in the downstream side passage is smaller than a first shape factor defined by a height and a pitch of the first turbulators with respect to the flow direction of the cooling fluid in the upstream side passage.

With the above configuration (3), the first shape factor in the upstream side passage is smaller than the second shape factor in the downstream passage. Thus, the above-described heat-transfer coefficient is relatively low in the upstream side passage, and cooling of the turbine blade is suppressed, making it possible to maintain the temperature of the cooling fluid from the upstream side passage toward the downstream side passage relatively low, and the above-described heat-transfer coefficient is relatively high in the downstream side passage, and cooling of the turbine blade is promoted, making it possible to enhance cooling of the turbine blade in the downstream side region of a folded flow passage. Thus, it is possible to reduce the amount of the cooling fluid supplied to the folded flow passage to cool the turbine blade, making it possible to improve thermal efficiency of the turbine including the gas turbine and the like.

(4) In some embodiments, in the above configuration (3), a second angle formed by the second turbulators with respect to the flow direction of the cooling fluid in the most downstream passage is smaller than a first angle formed by the first turbulators with respect to the flow direction of the cooling fluid in the upstream side passage.

In the cooling passages, in the range where the angle formed by the turbulators with respect to the flow direction of the cooling fluid (may also be referred to as the "inclination angle" hereinafter) is in the vicinity of 90 degrees, the heat-transfer coefficient between the cooling fluid and the turbine blade tends to high as the inclination angle is small.

In this regard, with the above configuration (4), the inclination angle (second angle) of the second turbulators in the most downstream passage is smaller than the inclination angle (first angle) of the first turbulators in the upstream side passage of the serpentine flow passage. Thus, the above-described heat-transfer coefficient is relatively low in the upstream side passage, and cooling of the turbine blade is suppressed, making it possible to maintain the temperature of the cooling fluid from the upstream side passage toward the downstream side passage relatively low, and the above-described heat-transfer coefficient is relatively high in the downstream side passage, and cooling of the turbine blade is promoted, making it possible to enhance cooling of the turbine blade in the downstream side region of the folded flow passage. Thus, it is possible to further reduce the amount of the cooling fluid supplied to the folded flow passage to cool the turbine blade, making it possible to further improve thermal efficiency of the turbine including the gas turbine and the like.

(5) In some embodiments, in any one of the above configuration (1), (2), or (4), the upstream side passage is provided with a plurality of first turbulators arranged along the blade height direction, the downstream side passage is provided with a plurality of second turbulators arranged along the blade height direction, and an average of second angles of the plurality of second turbulators is smaller than an average of first angles of the plurality of first turbulators.

With the above configuration (5), the average of the inclination angles (second angles) of the plurality of second turbulators in the most downstream passage is smaller than the average of the inclination angles (first angles) of the plurality of first turbulators in the upstream side passage of the serpentine flow passage. Thus, as described in the above configuration (1), it is possible to maintain the temperature of the cooling fluid from the upstream side passage toward the downstream side passage relatively low, and to enhance cooling of the turbine blade in the downstream side region of the serpentine flow passage. Thus, it is possible to reduce the amount of the cooling fluid supplied to the serpentine flow passage to cool the turbine blade, making it possible to improve thermal efficiency of the turbine including the gas turbine and the like.

(6) In some embodiments, in any one of the above configurations (2) to (4), the upstream side passage is provided with a plurality of first turbulators arranged along the blade height direction, the downstream side passage is provided with a plurality of second turbulators arranged along the blade height direction, and an average of the second shape factors of the plurality of second turbulators is smaller than an average of the first shape factors of the plurality of first turbulators.

(7) In some embodiments, in any one of the above configurations (2) to (4) or (6), the first shape factors of some of the first turbulators are smaller than an average of the first shape factors of other of the first turbulators in the same passage.

With the above configuration (7), even if a hot spot occurs in the blade inner wall in the same passage, it is possible to enhance local cooling by making the first shape factors of the first turbulators in the part smaller than the first shape factors of the other first turbulators.

(8) In some embodiments, in any one of the above configurations (1) to (7), the turbine blade includes the first turbulators provided in the upstream side passage and having the first angle of 90 degrees.

As described above, in the range where the inclination angle of the turbulators in the cooling passages is in the vicinity of 90 degrees, the heat-transfer coefficient between the cooling fluid and the turbine blade tends to high as the inclination angle is small. In this regard, with the above configuration (8), since the inclination angle (first angle) of the first turbulators in the upstream side passage is 90 degrees, and the inclination angle (second angle) of the second turbulators in the most downstream passage is less than 90 degrees, it is possible to maintain the temperature of the cooling fluid from the upstream side passage toward the downstream side passage relatively low, and to enhance cooling of the turbine blade in the downstream side region of the serpentine flow passage. Thus, it is possible to reduce the amount of the cooling fluid supplied to the serpentine flow passage to cool the turbine blade, making it possible to improve thermal efficiency of the turbine including the gas turbine and the like.

(9) In some embodiments, in any one of the above configurations (2) to (4), (6) or (7), the first shape factor is represented by a ratio P1/e1 of a pitch P1 of an adjacent pair of first turbulators of the plurality of first turbulators to a height e1 of the pair of first turbulators with reference to the inner wall surface of the upstream side passage, and the second shape factor is represented by a ratio P2/e2 of a pitch P2 of an adjacent pair of second turbulators of the plurality of second turbulators to a height e2 of the pair of second turbulators with reference to the inner wall surface of the downstream side passage.

Provided that a ratio P/e of a pitch P of an adjacent pair of turbulators of a plurality of turbulators provided in the cooling passages to an average height e of the these turbulators with reference to the inner wall surfaces of the cooling passages is the a shape factor, the heat-transfer coefficient between the cooling fluid and the turbine blade tends to high as the shape factor P/e is small.

In this regard, with the above configuration (9), the first shape factor P1/e1 in the upstream side passage is smaller than the second shape factor P2/e2 in the downstream side passage. Thus, the above-described heat-transfer coefficient is relatively low in the upstream side passage, and cooling of the turbine blade is suppressed, making it possible to maintain the temperature of the cooling fluid from the upstream side passage toward the downstream side passage relatively low, and the above-described heat-transfer coefficient is relatively high in the downstream side passage, and cooling of the turbine blade is promoted, making it possible to enhance cooling of the turbine blade in a downstream side region of the serpentine flow passage. Thus, it is possible to further reduce the amount of the cooling fluid supplied to the serpentine flow passage to cool the turbine blade, making it possible to further improve thermal efficiency of the turbine including the gas turbine and the like.

(10) In some embodiments, in any one of the above configurations (1) to (9), the downstream side passage includes the most downstream passage positioned on a most downstream side of the flow direction of the cooling fluid of the plurality of cooling passages, and the upstream side passage includes the cooling passage arranged adjacent to the most downstream passage.

The cooling fluid which flows through the plurality of cooling passages forming the serpentine flow passage increases downward in temperature by a heat exchange with the turbine blade to be cooled. The temperature of the cooling fluid is the highest in the most downstream passage positioned on the most downstream side of the flow of the cooling fluid.

In this regard, with the above configuration (10), in the downstream side passage including the most downstream passage, the inclination angle of the turbulators is smaller than in the upstream side passage arranged adjacent to the most downstream passage. Thus, the above-described heat-transfer coefficient is relatively low in the upstream side passage, and cooling of the turbine blade is suppressed, making it possible to relatively maintain the temperature of the cooling fluid from the upstream side passage toward the most downstream passage, and the above-described heat-transfer coefficient is relatively high in the most downstream passage, and cooling of the turbine blade is promoted, making it possible to enhance cooling of the turbine blade in the most downstream passage. Thus, it is possible to effectively reduce the amount of the cooling fluid supplied to the folded flow passage to cool the turbine blade, and to improve thermal efficiency of the turbine including the gas turbine and the like.

(11) In some embodiments, in any one of the above configurations (1) to (10), the plurality of cooling passages are a serpentine passage including at least the three cooling passages.

With the above configuration (11), it is possible to make the inclination angle (second angle) of the second turbulators in the most downstream passage of at least the three cooling passages smaller than the inclination angle (first angle) of the first turbulators in the upstream side passage of at least the three cooling passages forming the serpentine flow passage. Thus, as described in the above configuration (1), it is possible to reduce the amount of the cooling fluid supplied to the serpentine flow passage to cool the turbine blade, making it possible to improve thermal efficiency of the turbine including the gas turbine and the like.

(12) In some embodiments, in the above configuration (11), the plurality of cooling passages include a most upstream passage positioned on a most upstream side of the flow direction of the cooling fluid of the plurality of cooling passages, and an inner wall surface of the most upstream passage is formed by a smooth surface which is not provided with any turbulators.

In a case in which the inner wall surface of the cooling passage is formed by the smooth surface which is not provided with any turbulators, the heat-transfer coefficient between the cooling fluid and the turbine blade is low, as compared with a case in which the turbulators are provided on the inner wall surface of the cooling passage.

In this regard, with the above configuration (12), since the inner wall surface of the most upstream passage positioned on the most upstream side of the plurality of cooling passages is formed by the smooth surface which is not provided with any turbulators, the above-described heat-transfer coefficient in the most upstream passage is lower than the above-described heat-transfer coefficient in the upstream side passage. That is, the above-described heat-transfer coefficient in the most upstream passage, the upstream side passage, and the downstream side passage forming the serpentine flow passage increases in this order. Thus, the heat-transfer coefficient is easily changed in stages in the serpentine flow passage, facilitating adjustment of the cooling performance in each of the cooling passages.

(13) In some embodiments, in any one of the above configurations (1) to (12), the downstream side passage includes the most downstream passage positioned on the most downstream side of a flow of the cooling fluid of the plurality of cooling passages, and the most downstream passage is formed such that a flow passage area thereof decreases toward the downstream side of the flow of the cooling fluid.

With the above configuration (13), since the most downstream passage is formed such that the flow passage area thereof decreases toward the downstream side of the flow of the cooling fluid, the flow velocity of the cooling fluid is increased toward downstream in the most downstream passage. Thus, it is possible to improve cooling efficiency in the most downstream passage where the temperature of the cooling fluid is relatively high.

(14) In some embodiments, in any one of the above configurations (1) to (13), the downstream side passage includes the most downstream passage positioned on the most downstream side of a flow of the cooling fluid of the plurality of cooling passages, and the turbine blade further includes a cooling fluid supply path disposed so as to communicate with an upstream part of the most downstream passage and configured to supply a cooling fluid from outside to the most downstream passage without via the upstream side passage.

With the above configuration (14), in addition to the inflow of the cooling fluid from the upstream side passage to the most downstream passage, the cooling fluid from outside is supplied to the most downstream passage via the cooling fluid supply path. Thus, it is possible to further enhance cooling in the most downstream passage where the temperature of the cooling fluid from the upstream side passage is relatively high.

(15) In some embodiments, in any one of the above configurations (1) to (14), the turbine blade is a rotor blade for a gas turbine.

With the above configuration (15), since the rotor blade for the gas turbine as the turbine blade has any one of the above configurations (1) to (14), it is possible to reduce the amount of the cooling fluid supplied to the serpentine flow passage to cool the rotor blade, making it possible to improve thermal efficiency of the gas turbine.

(16) In some embodiments, in any one of the above configurations (1) to (14), the turbine blade is a stator vane for a gas turbine.

With the above configuration (16), since the stator vane for the gas turbine as the turbine blade has any one of the above configurations (1) to (14), it is possible to reduce the amount of the cooling fluid supplied to the serpentine flow passage to cool the stator vane, making it possible to improve thermal efficiency of the gas turbine.

(17) A gas turbine according to at least one embodiment of the present invention includes the turbine blade according to any one of the above configurations (1) to (16), and a combustor for producing a combustion gas to flow through a combustion gas flow passage in which the turbine blade is disposed.

With the above configuration (17), since the turbine blade has any one of the above configurations (1) to (16), it is possible to reduce the amount of the cooling fluid supplied to the serpentine flow passage to cool the turbine blade, making it possible to improve thermal efficiency of the gas turbine.

Advantageous Effects

According to at least one embodiment of the present invention, a turbine blade and a gas turbine are provided, which are capable of efficiently cooling a turbine.

DETAILED DESCRIPTION

Figure 1:
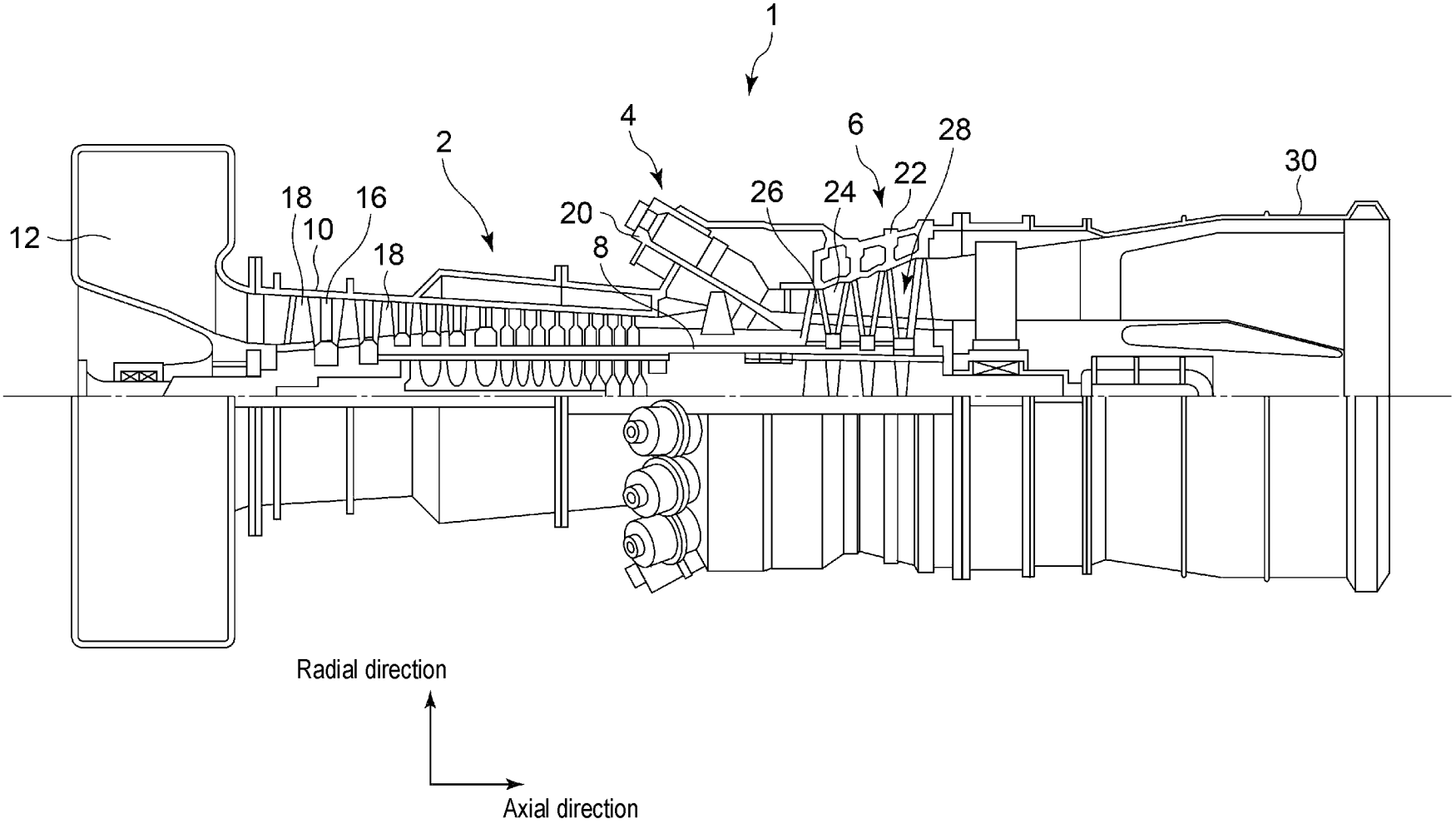
FIG. 1 is a schematic configuration view of a gas turbine to which a turbine blade is applied according to an embodiment.

Some embodiments of the present invention will be described below with reference to the accompanying drawings. It is intended, however, that unless particularly identified, dimensions, materials, shapes, relative positions and the like of components described in the embodiments or shown in the drawings shall be interpreted as illustrative only and not intended to limit the scope of the present invention.

First, a gas turbine to which the turbine blade is applied according to some embodiments will be described.

The basic idea of the present invention common to some embodiments to be described later will be described below.

Since a representative turbine blade is arranged in an atmosphere of a high-temperature combustion gas, the interior of an airfoil body is cooled with a cooling fluid in order to prevent thermal damage from a combustion gas of the airfoil body. The airfoil body is cooled by flowing the cooling fluid into a serpentine flow passage formed in the airfoil body. In addition, in order to further enhance cooling performance by the cooling fluid of the airfoil body, a turbulence promoting member (turbulator) is arranged on a blade inner wall of a passage through which the cooling fluid flows. That is, an optimum turbulator is selected, and a heat-transfer coefficient between the cooling fluid and the blade inner wall is increased as much as possible, thereby implementing an optimum cooling structure of the airfoil body.

However, in order to further improve thermal efficiency of the gas turbine, the flow rate of the cooling fluid may need a further reduction. The reduction in the flow rate of the cooling fluid brings about a decrease in the flow velocity of the cooling fluid, resulting in a decrease in the cooling performance of the airfoil body and an increase in a metal temperature of the airfoil body. Thus, a measure to, for example, reduce the cross-sectional area of the passage and to increase the flow velocity is needed.

However, a cooling structure, in which the cross-sectional area of the passage is reduced, and a turbulator having the highest heat-transfer coefficient is applied, may not be an appropriate cooling structure for the blade, and a cooling structure suitable for the shape and an operation condition of the blade needs to be selected. For example, if a cooling structure having good cooling performance is applied to a blade with a blade shape having a high blade height (spanwise direction) relative to a blade length (a length in a chordwise direction) or blade aiming at improving thermal efficiency of the gas turbine by suppressing the flow rate of the cooling fluid relative to a heat load, the cooling fluid is heated up in the course whereby the cooling fluid flows through the serpentine flow passage, and a metal temperature of a final passage (most downstream passage) may exceed a service temperature limit. For such a blade, it is important to select an appropriate cooling structure in which heatup is suppressed, and the metal temperature of the final passage does not exceed the service temperature limit.

More specifically, it is desirable to select a turbulator which has a heat-transfer coefficient between the flow of the cooling fluid and the blade surface kept low for a turbulator of an upstream side passage on the upstream side of the final passage, and to select a turbulator having the highest heat-transfer coefficient for a turbulator of the final passage. With the above-described selection, heatup of a cooling fluid flowing through the upstream side passage is suppressed and in the course whereby the cooling fluid suppressed in heatup flows through the final passage, cooling performance by the cooling fluid with respect to the airfoil body is improved by applying a turbulator having a high heat-transfer coefficient. As a result, it is possible to keep the metal temperature of the final passage not more than the service temperature limit. In addition, as described above, keeping the heat-transfer coefficient low has an effect of reducing a pressure loss of the cooling fluid. Therefore, with multiple effects of the effect of suppressing the heatup and the effect of reducing the pressure loss of the cooling fluid, the cooling performance in the final passage is maximized.

Figure 4:
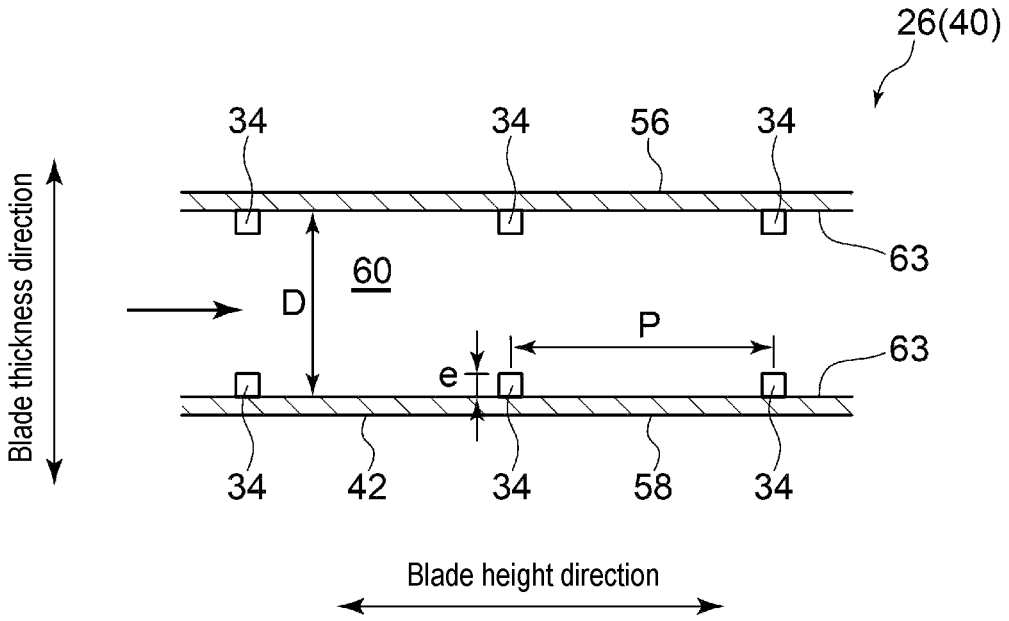
FIG. 4 is a schematic view for describing the configuration of turbulators according to an embodiment.
Figure 5:
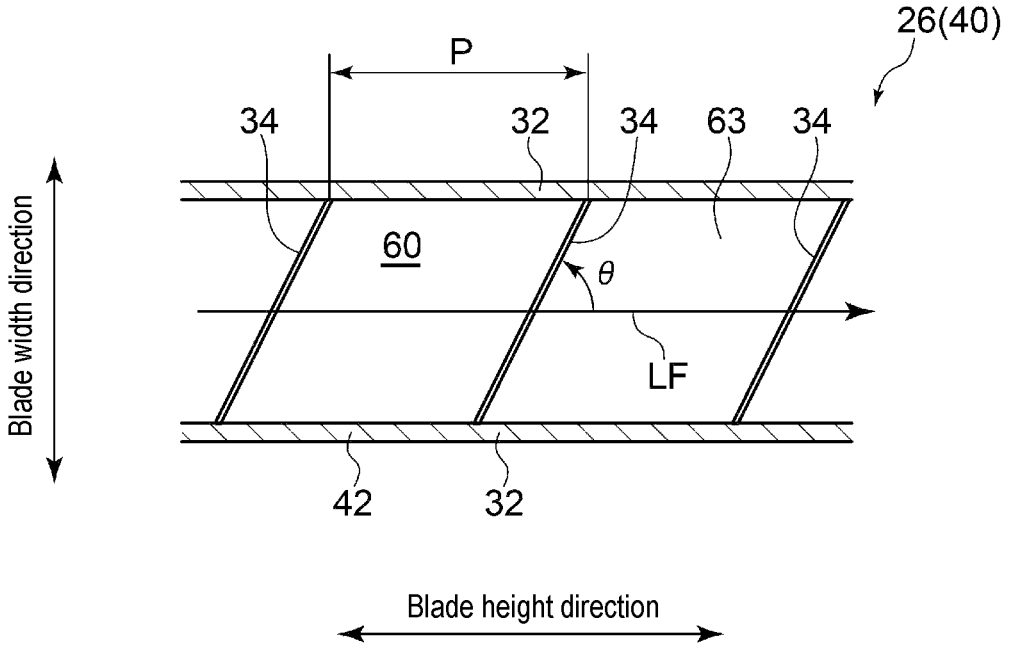
FIG. 5 is a schematic view for describing the configuration of the turbulators according to an embodiment.

As shown in FIGS. 4 and 5, turbulators are formed by protruding ribs which are disposed on a blade inner wall forming a cooling flow passage, the details of which are to be described later. The ribs are arranged at predetermined intervals in a flow direction of the cooling fluid. When the cooling fluid flows over the ribs, a swirl is generated on the downstream side of the flow direction, promoting heat transfer between the blade inner wall and the flow of the cooling fluid. Therefore, there is a large difference in heat-transfer coefficient between a blade inner wall having a smooth surface without any rib and a blade inner wall with the ribs.

Factors defining the performance and the specifications of the turbulators are inclination angles and shape factors of the turbulators.

Figure 13:
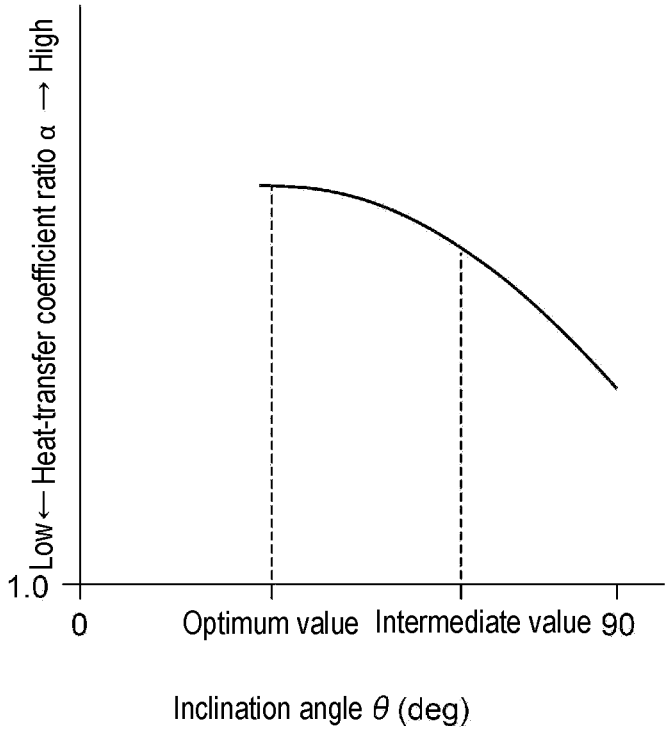
FIG. 13 is a graph showing an example of a correlation between a heat-transfer coefficient ratio $\alpha$ and an inclination angle $\theta$ of the turbulators.
Figure 14:
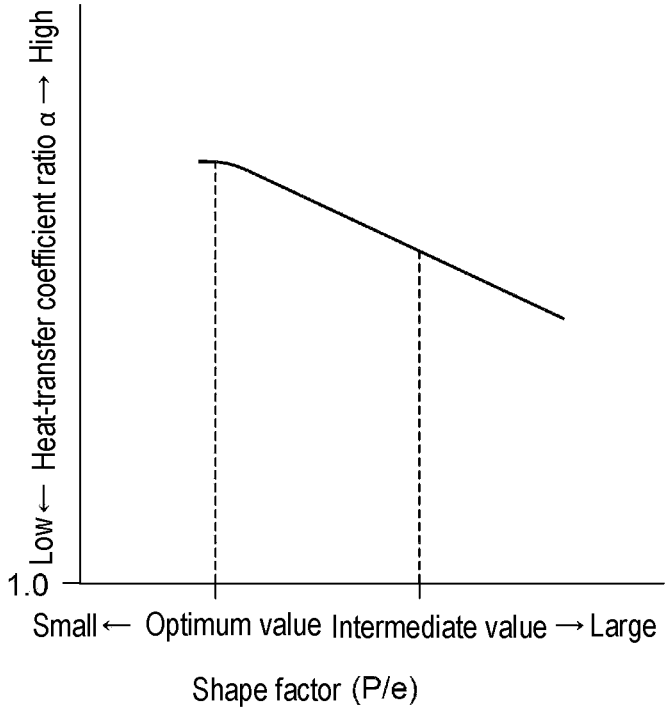
FIG. 14 is a graph showing an example of a correlation between the heat-transfer coefficient ratio $\alpha$ and a shape factor P/e of the turbulators.

FIG. 13 shows a relationship between the inclination angle of the turbulators and the heat-transfer coefficient between the cooling fluid and the blade inner wall, and FIG. 14 shows a relationship between the shape factor of the turbulators and the heat-transfer coefficient between the cooling fluid and the blade inner wall, the details of which are to be described later. If the turbulators have the inclination angle which is an optimum angle (optimum value) and the shape factor which is also an optimum factor (optimum value), the highest heat-transfer coefficient and the best cooling performance are obtained. As a result, cooling of a blade inner wall surface is promoted, making it possible to decrease the metal temperature of the cooling flow passage. On the other hand, if turbulators are selected which have the inclination angle which is an intermediate angle (intermediate value) larger than the optimum value and have the shape factor which is also an intermediate factor (intermediate value) larger than the optimum value, the heat-transfer coefficient is lower, and the cooling performance is suppressed as compared with a case in which the optimum values of the inclination angle and the shape factor are applied.

As described above, depending on the blade shape and the operation condition, adopting a blade structure having a cooling structure, in which the cooling performance is suppressed in the upstream side passage and the cooling performance is maximized in the final passage, rather than selecting turbulators having the highest heat-transfer coefficient and good cooling performance may be appropriate as a cooling structure of an entire blade. A specific blade configuration along the above-descried idea will be described with reference to a blade configuration of each of the embodiments to be described later. In the cooling structure of each of the embodiments to be described below, the turbulator specifications of the upstream side passage have a configuration which varies according to the respective embodiments. However, the configuration is common to the respective embodiments in that the optimum values are selected for both the inclination angle and the shape factor of the turbulators in the final passage.

Figure 6:
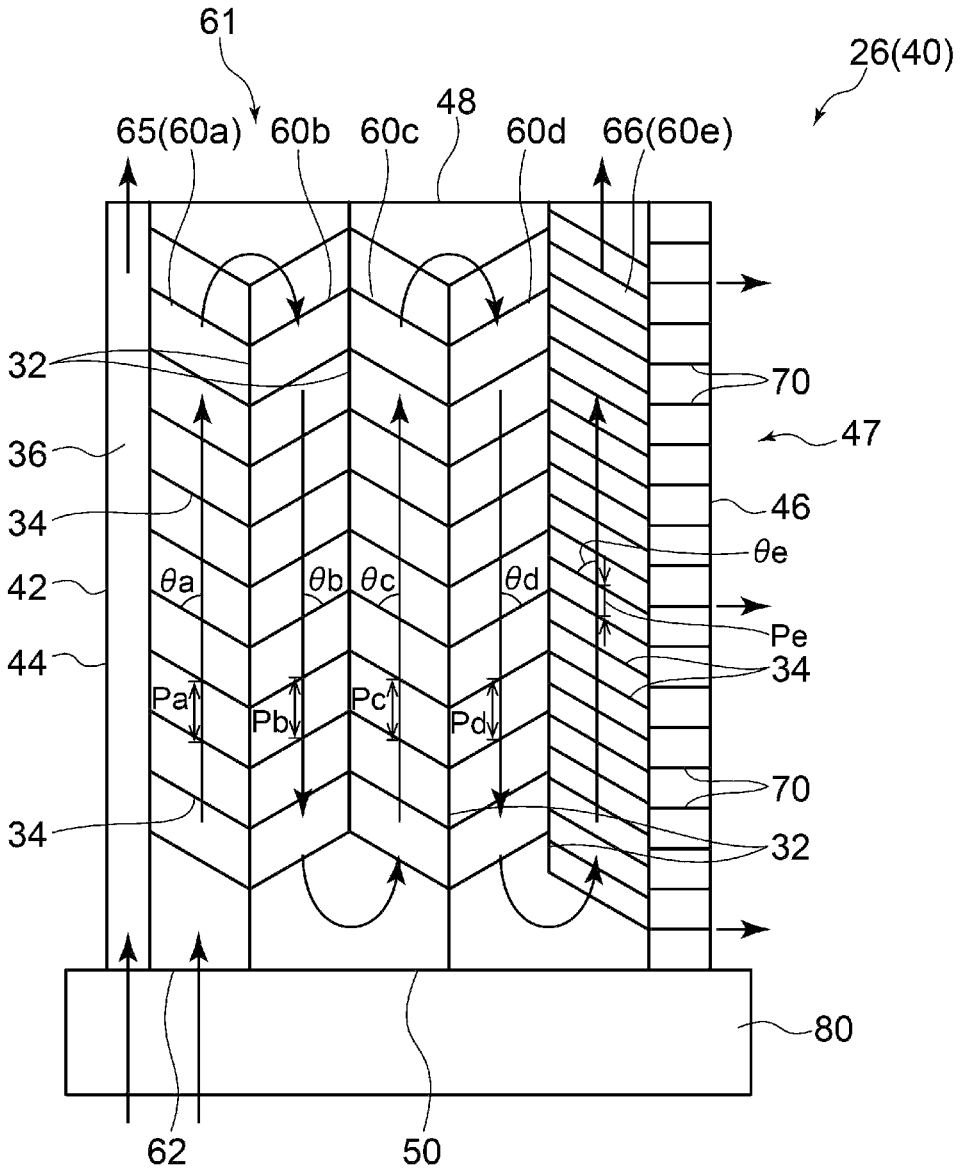
FIG. 6 is a schematic cross-sectional view of the rotor blade (turbine blade) according to an embodiment.

In the embodiment shown in FIG. 6, inclination angles are selected in which the inclination angles of the turbulators are optimum values for all passages. For the shape factor, the optimum value is selected in the final passage, and the intermediate value is selected in the upstream side passage on the upstream side of the final passage. With such a cooling structure, heatup of the cooling fluid in the upstream side passage is suppressed. On the other hand, since the airfoil body is sufficiently cooled in the course whereby the cooling fluid flows through the final passage having good cooling performance, the metal temperature of the blade inner wall is prevented from increasing and does not exceed the service temperature limit.

Figure 7:
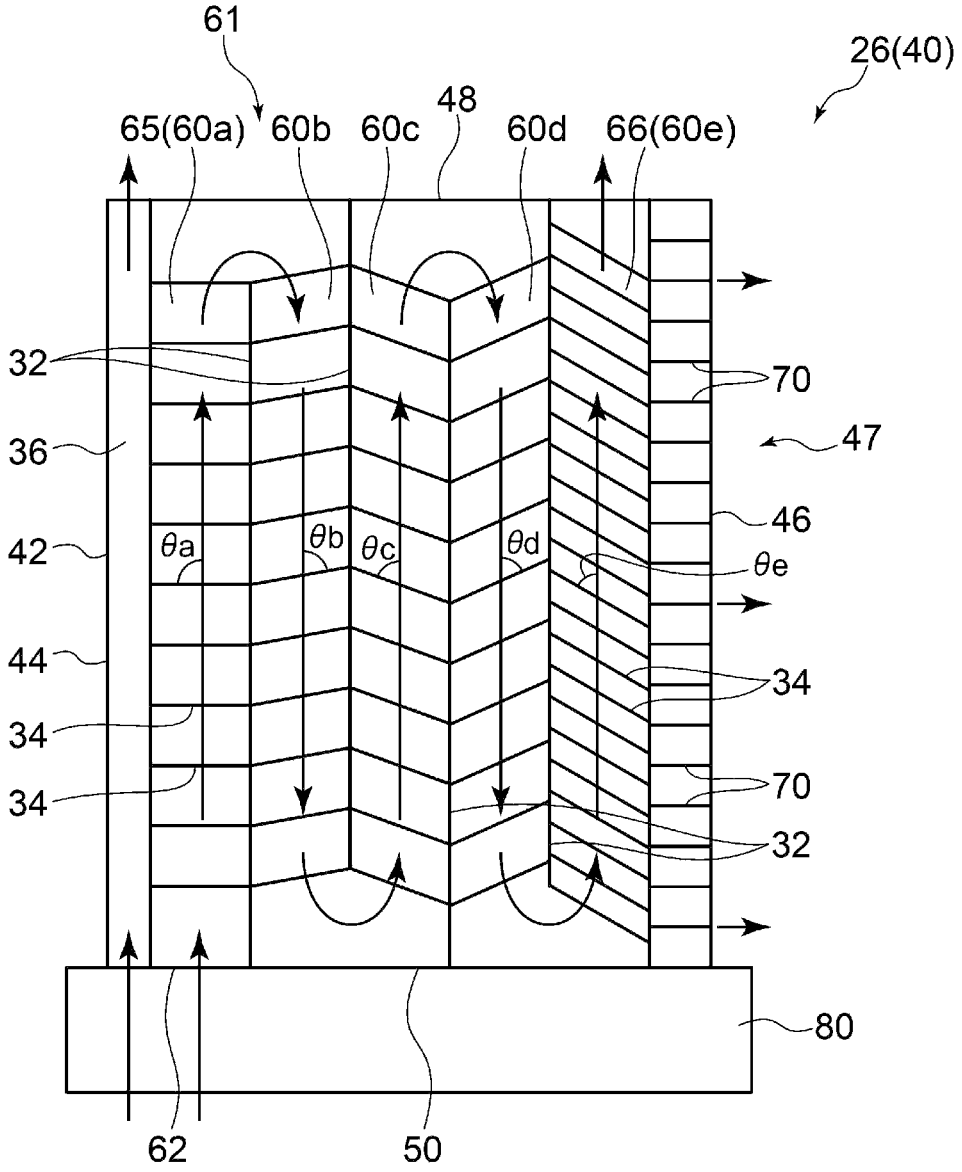
FIG. 7 is a schematic cross-sectional view of the rotor blade (turbine blade) according to an embodiment.

The embodiment shown in FIG. 7 is an example in which the cooling performance of the upstream side passage is further suppressed relative to the cooling structure in FIG. 6. That is, the embodiment shown in FIG. 7 is an example in which the intermediate angle (intermediate value) which is larger than the optimum angle (optimum value) is selected for the inclination angle of the turbulators in the upstream side passage, as compared with the cooling structure in FIG. 6. A margin is produced in a cooling capacity of the final passage in a case in which the metal temperature of the upstream side passage does not exceed the service temperature limit even if the heat-transfer coefficient of the upstream side passage is further suppressed as compared with the cooling structure in FIG. 6. Thus, the embodiment shown in FIG. 7 has a further advantage over the cooling structure in FIG. 6 in terms of the cooling capacity of the final passage. That is, in the cooling structure shown in FIG. 7, the intermediate value is selected at which inclination angles of the turbulators in all upstream side passages on the upstream side of the final passage are larger than the inclination angle (optimum value) of the turbulators in the final passage. However, different intermediate values are selected for the inclination angles in the respective passages. The selection is made such that the inclination angle of the turbulators in the most upstream passage of the upstream side passages is smaller than 90 degrees, and the inclination angles of the turbulators in the respective upstream side passages gradually decrease toward the final passage. Moreover, regarding the shape factor of the turbulators, the same intermediate value is selected in the upstream side passages, and the optimum value is selected in the final passage, as the same configuration as the cooling structure in FIG. 6. With such a cooling structure, as compared with the cooling structure shown in FIG. 6, cooling in the upstream side passage is suppressed, the temperature of the cooling fluid is decreased than in the structure shown in FIG. 6, and the margin is produced in the cooling capacity in the final passage. Therefore, it is possible to gradually enhance the cooling performance while suppressing the heatup of the cooling fluid in the upstream side passage, making it possible to compensate for deficiency in the cooling capacity in the final passage.

Figure 8:
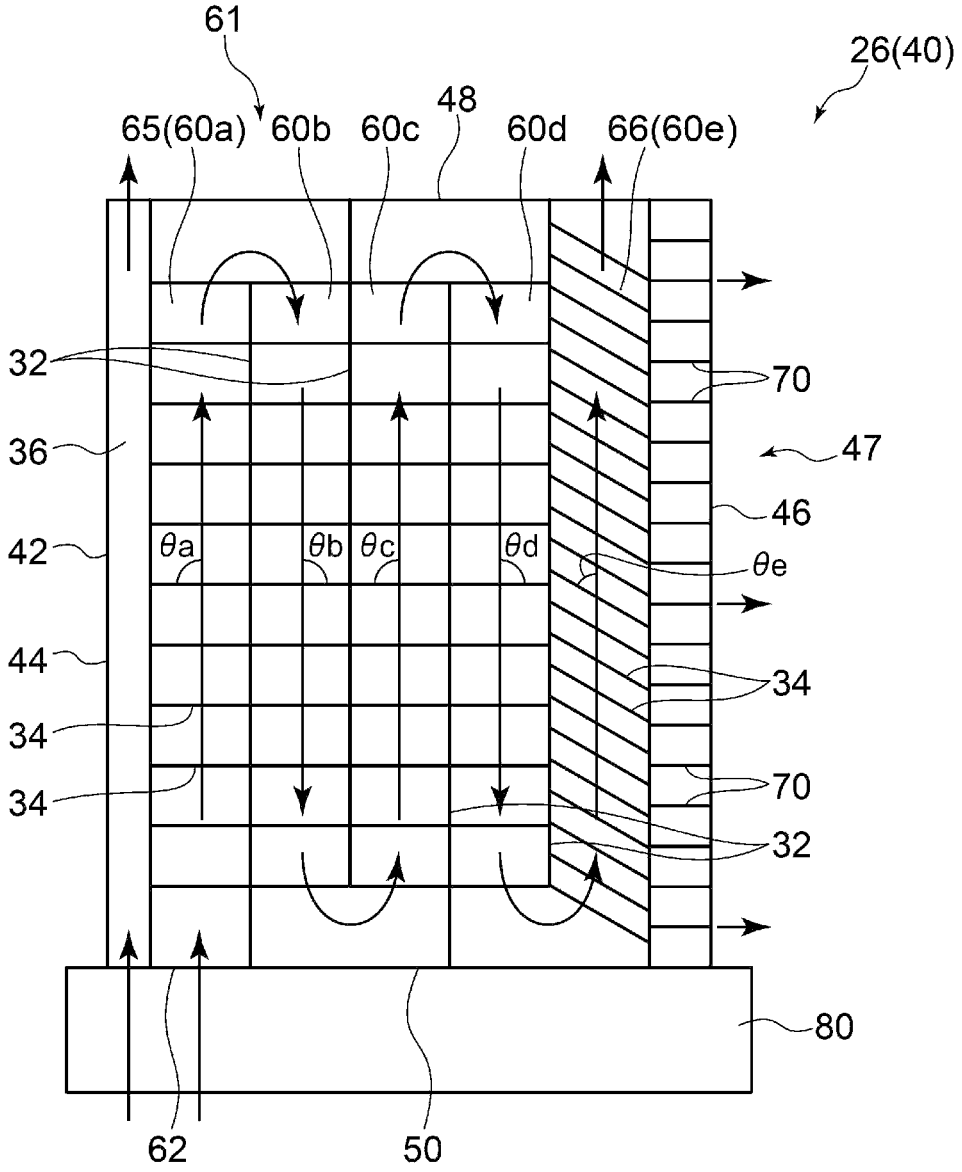
FIG. 8 is a schematic cross-sectional view of the rotor blade (turbine blade) according to an embodiment.

The embodiment shown in FIG. 8 is an example in which the cooling performance of the upstream side passage is further suppressed relative to the cooling structure in FIG. 7. That is, with the cooling structure shown in FIG. 8 as well, a further margin is produced in the cooling capacity of the final passage in the case in which the metal temperature of the upstream side passage does not exceed the service temperature limit. That is, in the cooling structure shown in FIG. 8, the inclination angle of the turbulators in the upstream side passage is 90 degrees across the board, and only the inclination angle of the turbulators in the final passage has the optimum value. Moreover, regarding the shape factor of the turbulators, the intermediate value is selected in the upstream side passage, and the optimum value is selected in the final passage, as the same configuration as the cooling structure in FIG. 6. With such a cooling structure, heatup of the cooling fluid in the upstream side passage is further suppressed as compared with the cooling structure shown in FIG. 7. Therefore, an inflow temperature of the cooling fluid supplied to the final passage is further lower than in the structure shown in FIG. 7. In the course whereby the cooling fluid flows through the final passage, as compared with the structure in FIG. 7, the final passage is cooled more easily, the increase in the metal temperature of the blade inner wall is suppressed, and the metal temperature of the final passage can be kept within the service temperature limit.

Figure 9:
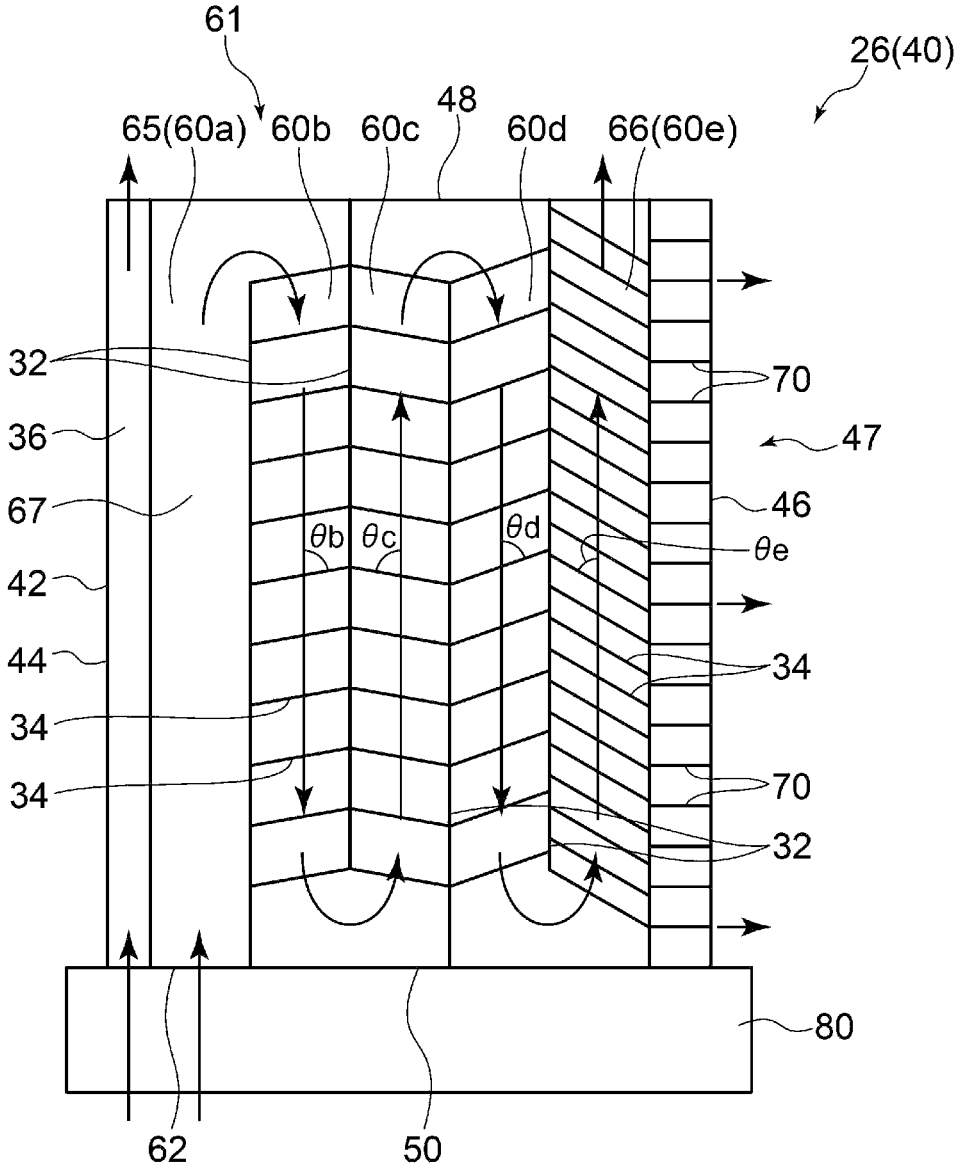
FIG. 9 is a schematic cross-sectional view of the rotor blade (turbine blade) according to an embodiment.

In the embodiment shown in FIG. 9, the cooling performance of the upstream side passage is further suppressed relative to the cooling structure in FIG. 8. That is, the blade configuration shown in the present embodiment is such that no turbulator is arranged in the most upstream passage in the upstream side passage, and a flow passage inner wall is formed by a smooth surface. Heatup of the cooling fluid is further suppressed, and a further margin is produced in the cooling capacity of the final passage, if the metal temperature of the most upstream passage is lower than the service temperature limit even in the case of the smooth surface without any turbulators. That is, in the structure shown in FIG. 9, the most upstream passage is formed by the smooth surface, the intermediate value is selected for the inclination angles of the turbulators in the other upstream side passages except the most upstream passage, and the intermediate value having the same configuration as FIG. 8 is selected for the shape factor of the turbulators. The inclination angle and the shape factor of the turbulators in the final passage are the same as the configuration of FIG. 6. With such a cooling structure, it is possible to further suppress heatup of the cooling fluid in the upstream side passage as compared with the cooling structure shown in FIG. 8. Moreover, a margin is produced in the cooling capacity of the cooling fluid in the final passage, and the final passage is cooled more easily.

Figure 10:
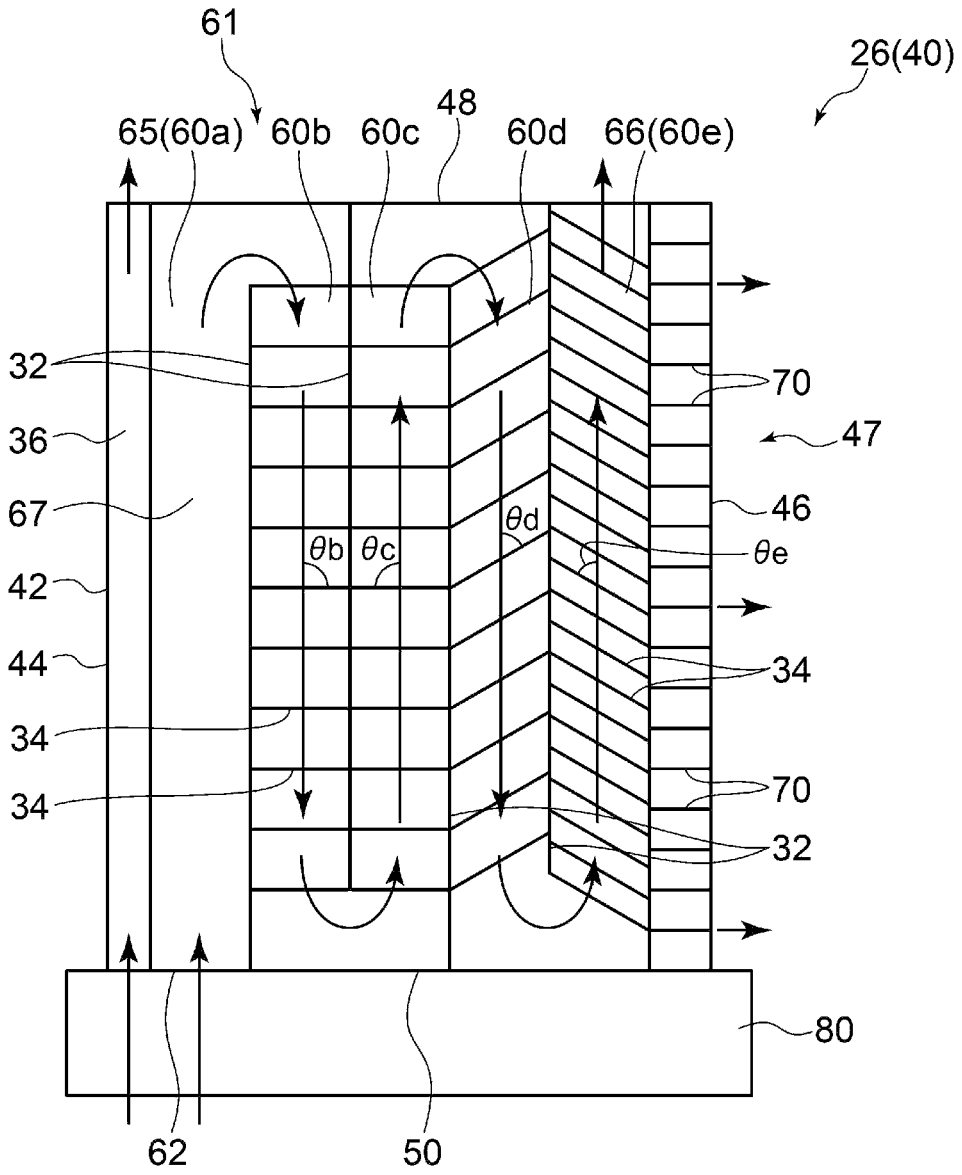
FIG. 10 is a schematic cross-sectional view of the rotor blade (turbine blade) according to an embodiment.

In the embodiment shown in FIG. 10, the cooling performance of the upstream side passage is further suppressed relative to the cooling structure in FIG. 9. The embodiment in FIG. 10 is common to the embodiment in FIG. 9 in that the most upstream passage is formed by the smooth surface and does not include the turbulators. However, the embodiment in FIG. 10 is different from the cooling structure shown in FIG. 9 in that the inclination angles of the turbulators in other two adjacent upstream side passages following the most upstream passage are 90 degrees. The inclination angle of the turbulators in the upstream side passage adjacent to the final passage is the same as the structure shown in FIG. 9. In addition, the inclination angle and the shape factor of the turbulators in the final passage are the same as the configuration shown in FIG. 6. Even in the case of such a cooling structure, it is possible to suppress heatup of the cooling fluid in the upstream side passage, and a further margin is produced in the cooling capacity of the final passage, if the metal temperature of the upstream side passage does not exceed the service temperature limit. With the cooling structure shown in FIG. 10, the final passage is cooled more easily, the increase in the metal temperature of the blade inner wall of the final passage is suppressed, and the metal temperature can be kept within the service temperature limit.

Figure 11:
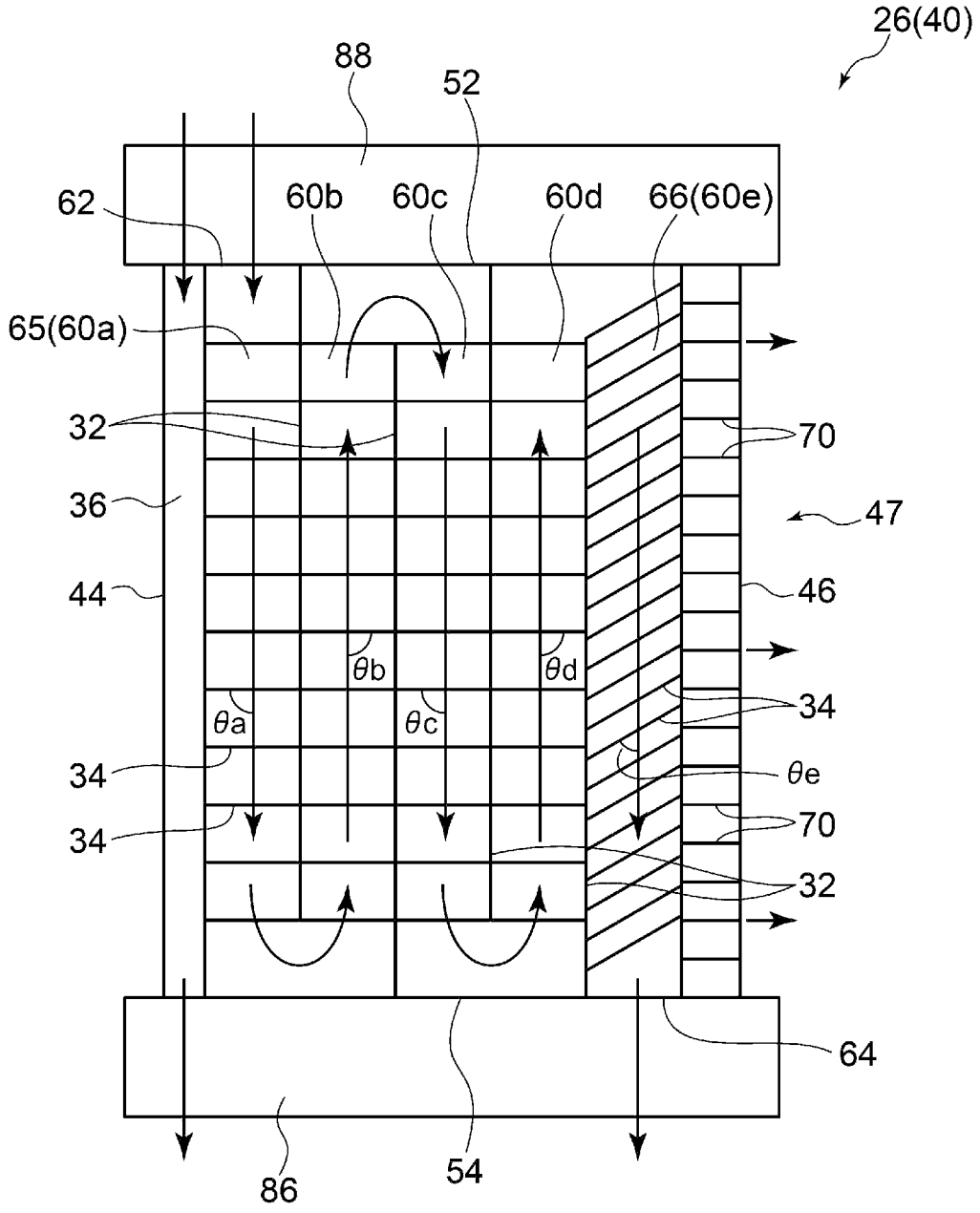
FIG. 11 is a schematic cross-sectional view of a stator vane (turbine blade) according to an embodiment.

The embodiment shown in FIG. 11 is an example in which a basic idea of the present invention is applied to a stator vane. In the case of the stator vane, an inlet of the cooling fluid supplied to the serpentine flow passage is disposed radially outward of the airfoil body, and the radial flow direction of the cooling fluid flowing through the final passage is opposite to that of the rotor blade. However, the inclination angle and the shape factor of the turbulators have the same configuration as FIG. 6. Even with such a cooling structure, compared with the blade configuration in which the optimum values are selected as the inclination angle and the shape factor of the turbulators, heatup of the cooling fluid in the upstream side passage is suppressed and in the course whereby the cooling fluid flows through the final passage, the increase in the metal temperature of the blade inner wall is suppressed, and the metal temperature can be kept within the service temperature limit.

As described above, selecting the appropriate turbulator specifications suitable for the blade shape and the operation condition, heatup of the cooling fluid in the upstream side passage is suppressed, the increase in the metal temperature of the airfoil body in the final passage is suppressed, and the gas turbine can efficiently be cooled. Specific contents of the respective embodiments will be described in detail below.

FIG. 1 is a schematic configuration view of the gas turbine to which the turbine blade is applied according to an embodiment. As shown in FIG. 1, a gas turbine 1 includes a compressor 2 for generating compressed air, combustors 4 for each generating a combustion gas from the compressed air and fuel, and a turbine 6 configured to be rotationally driven by the combustion gas. In the case of the gas turbine 1 for power generation, a generator (not shown) is connected to the turbine 6.

The compressor 2 includes a plurality of stator vanes 16 fixed to the side of a compressor casing 10 and a plurality of rotor blades 18 implanted on a rotor 8 so as to be arranged alternately with respect to the stator vanes 16.

Intake air from an air inlet 12 is sent to the compressor 2, and passes through the plurality of stator vanes 16 and the plurality of rotor blades 18 to be compressed, turning into compressed air having a high temperature and a high pressure.

Each of the combustors 4 is supplied with fuel and the compressed air generated by the compressor 2. In each of the combustors 4, the fuel and the compressed air are mixed and combusted to generate the combustion gas which serves as a working fluid of the turbine 6. As shown in FIG. 1, a plurality of combustors 4 may circumferentially be arranged in the casing 20 centering around the rotor.

The turbine 6 includes a combustion gas flow passage 28 formed in a turbine casing 22, and includes a plurality of stator vanes 24 and rotor blades 26 disposed in the combustion gas flow passage 28.

Each of the stator vanes 24 is fixed to the side of the turbine casing 22. The plurality of stator vanes 24 arranged along the circumferential direction of the rotor 8 form a stator vane row. Moreover, each of the rotor blades 26 is implanted on the rotor 8. The plurality of rotor blades 26 arranged along the circumferential direction of the rotor 8 form a rotor blade row. The stator vane row and the rotor blade row are alternately arranged in the axial direction of the rotor 8.

In the turbine 6, the combustion gas flowing into the combustion gas flow passage 28 from the combustors 4 passes through the plurality of stator vanes 24 and the plurality of rotor blades 26, rotary driving the rotor 8. Consequently, the generator connected to the rotor 8 is driven to generate power. The combustion gas having driven the turbine 6 is discharged outside via an exhaust chamber 30.

In some embodiments, at least either of the rotor blades 26 or the stator vanes 24 of the turbine 6 are turbine blades 40 to be described below.

A description will be given below mainly with reference to the drawings of the rotor blade 26 as the turbine blade 40.

However, the same description is basically applicable to the stator vane 24 as the turbine blade 40 as well.

Figure 2A:
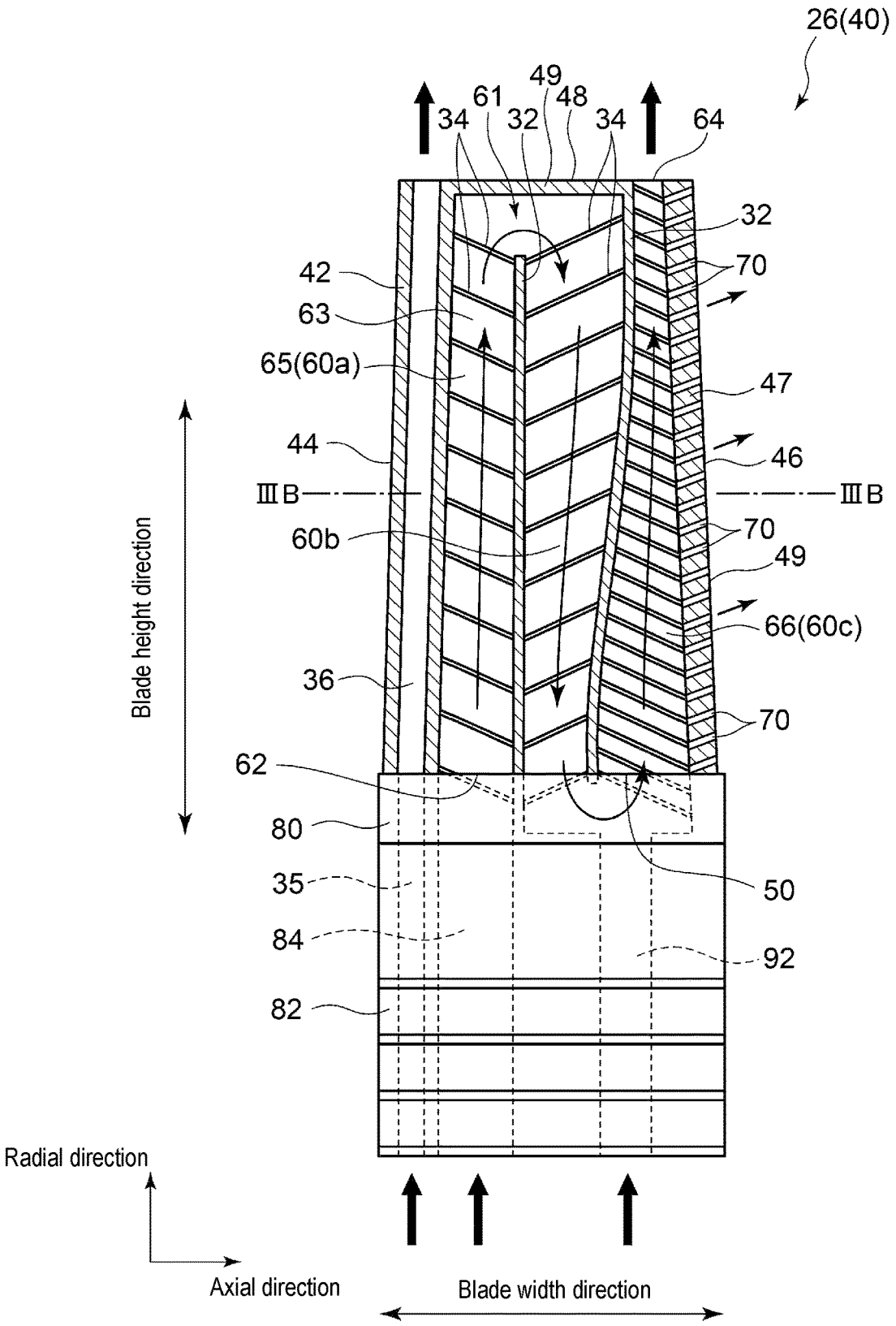
FIG. 2A is a partial cross-sectional view of a rotor blade (turbine blade) along a blade height direction according to an embodiment.
Figure 2B:
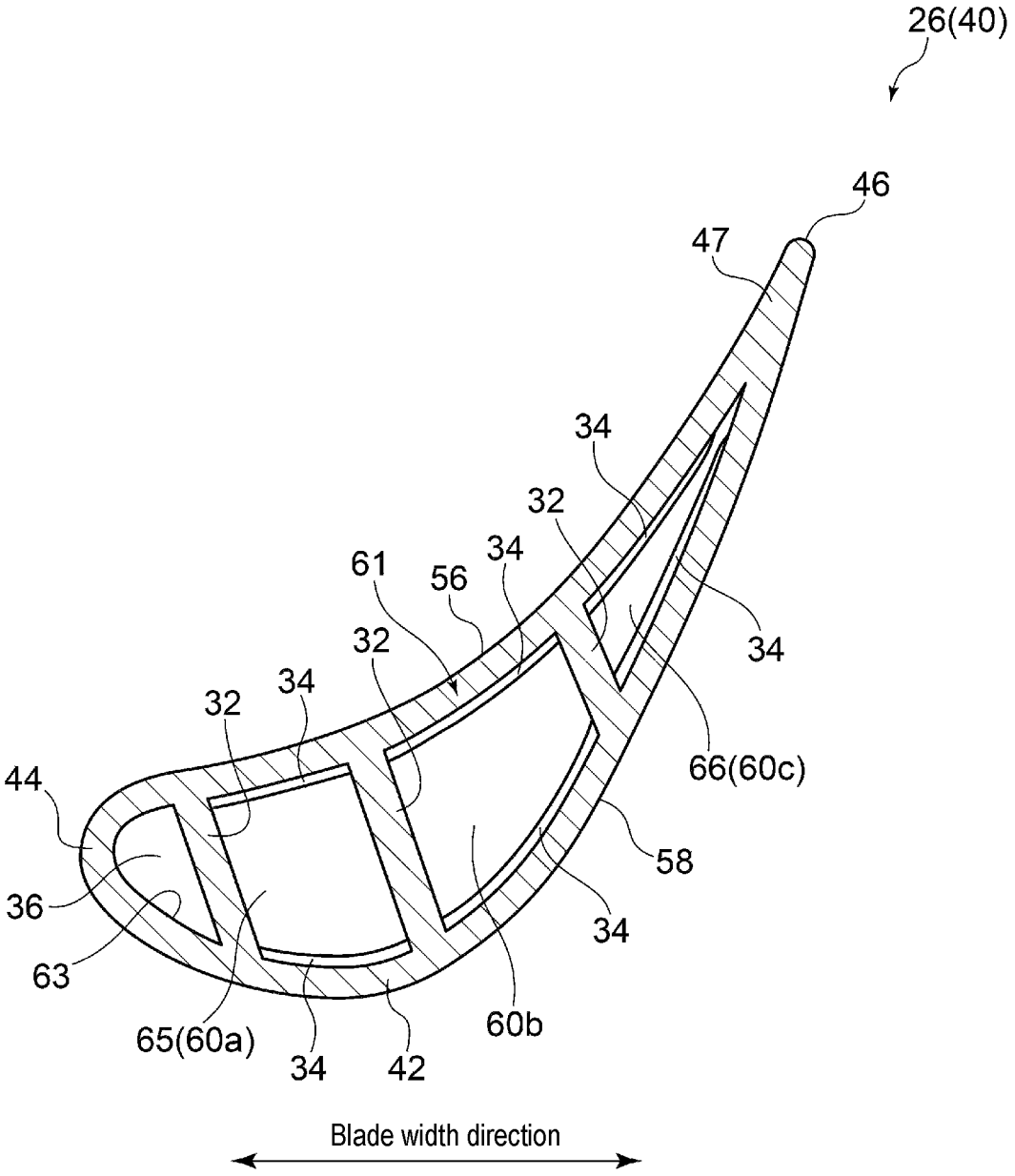
FIG. 2B is a view taken along line IIB-IIB of FIG. 2A.
Figure 3A:
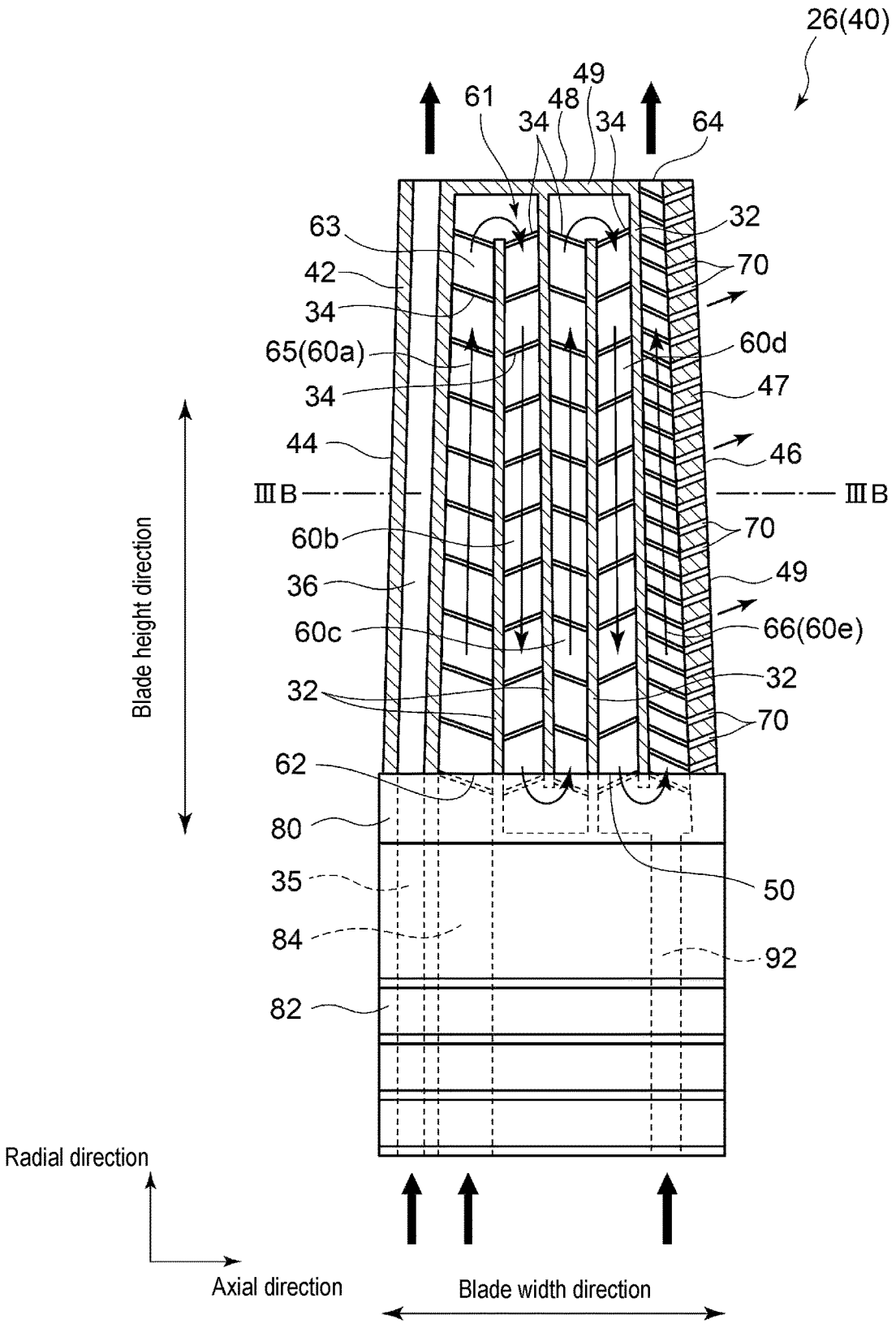
FIG. 3A is a partial cross-sectional view of the rotor blade (turbine blade) along the blade height direction according to an embodiment.
Figure 3B:
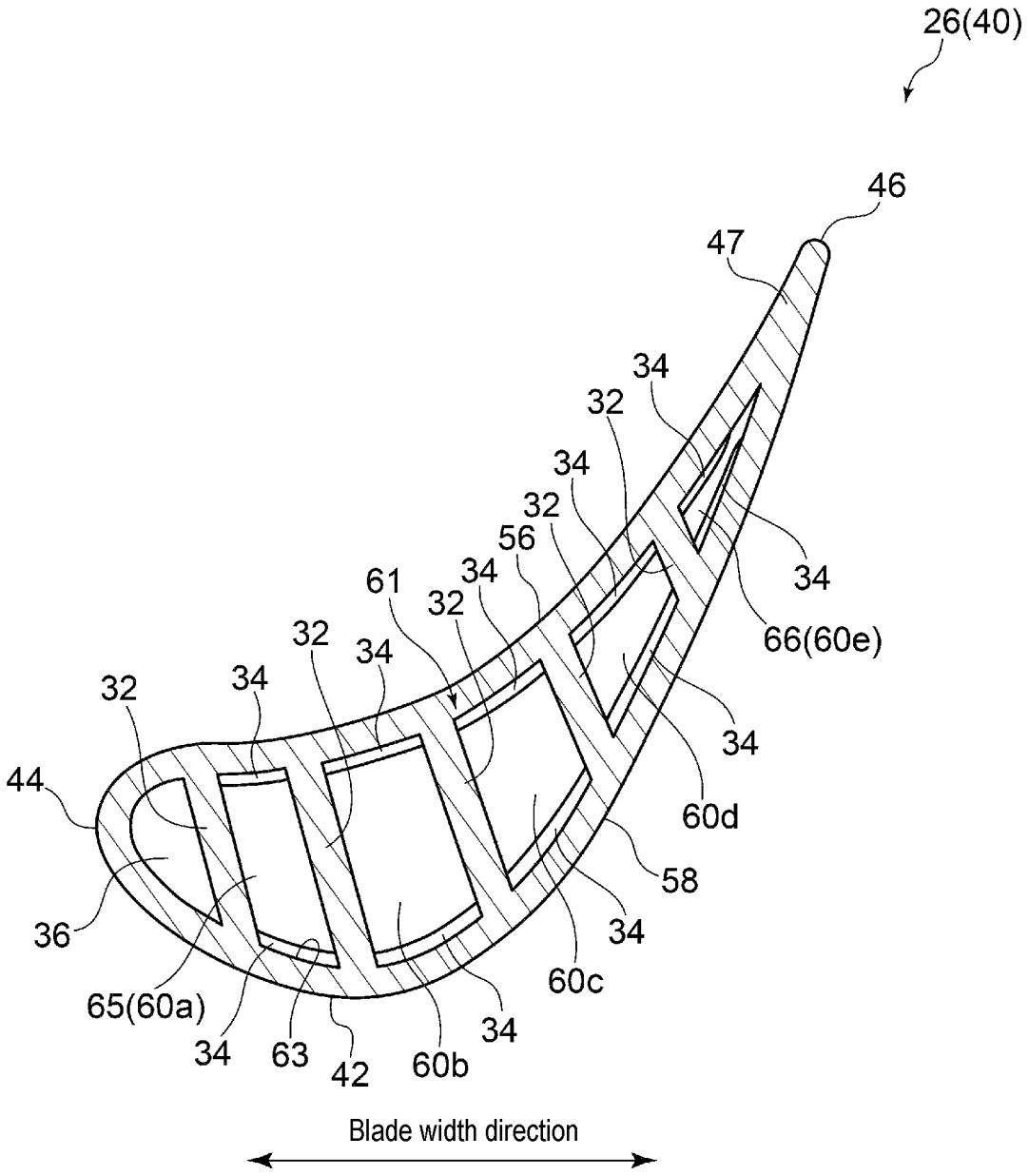
FIG. 3B is a view taken along line IIIB-IIIB of FIG. 3A.

FIGS. 2A and 3A are partial cross-sectional views of the rotor blade 26 (turbine blade 40) along a blade height direction according to an embodiment. FIGS. 2B and 3B are views taken along line IIIA-IIIA of FIG. 2A and taken along line IIIB-IIIB, respectively. Arrows in the views each indicate the flow direction of the cooling fluid.

As shown in FIGS. 2A to 3B, the rotor blade 26 as the turbine blade 40 according to an embodiment includes an airfoil body 42, a platform 80, and a blade root portion 82. The blade root portion 82 is embedded in the rotor 8 (see FIG. 1). The rotor blade 26 rotates together with the rotor 8. The platform 80 is formed integrally with the blade root portion 82.

The airfoil body 42 is disposed so as to extend along the radial direction of the rotor 8 (may simply be referred to as a "radial direction" or a "spanwise direction" hereinafter), and has a base 50 (end part 1) fixed to the platform 80 and a tip 48 (end part 2) which is positioned on a side opposite to the base 50 (radially outward) in the blade height direction (the radial direction of the rotor 8) and is made of a top board 49 forming the top of the airfoil body 42.

In addition, the airfoil body 42 of the rotor blade 26 has a leading edge 44 and a trailing edge 46 from the base 50 to the tip 48. An airfoil surface of the airfoil body 42 has a pressure surface (concave surface) 56 and a suction surface (convex surface) 58 extending along the blade height direction between the base 50 and the tip 48.

The airfoil body 42 internally includes a cooling flow passage for flowing a cooling fluid (for example, air) for cooling the turbine blade 40. In the exemplary embodiments shown in FIGS. 2A to 3B, in the airfoil body 42, a serpentine flow passage 61 and a leading-edge side flow passage 36 positioned between the serpentine flow passage 61 and the leading edge 44 are formed as cooling flow passages. A cooling fluid from outside is supplied to the folded flow passage 61 and the leading-edge side flow passage 36 via interior flow passages 84, 35, respectively.

By thus supplying the cooling fluid to the cooling flow passages such as the serpentine flow passage 61 and the leading-edge side flow passage 36, the airfoil body 42 disposed in the combustion gas flow passage 28 of the turbine 6 and exposed to the high-temperature combustion gas is cooled.

In the turbine blade 40, the serpentine flow passage 61 includes a plurality of cooling passages 60*a*, 60*b*, 60*c*, . . . (may collectively be referred to as "cooling passages 60" hereinafter) each extending along the blade height direction. The airfoil body 42 of the turbine blade 40 internally includes a plurality of ribs 32 along the blade height direction. The adjacent cooling passages 60 are divided by a corresponding one of the ribs 32.

In the exemplary embodiments shown in FIGS. 2A and 2B, the serpentine flow passage 61 includes the three cooling passages 60*a* to 60*c*. The cooling passages 60*a* to 60*c* are arranged in this order from the side of the leading edge 44 toward the side of the trailing edge 46. Moreover, in the exemplary embodiments shown in FIGS. 3A and 3B, the folded flow passage 61 includes the five cooling passages 60*a* to 60*e*. The cooling passages 60*a* to 60*e* are arranged in this order from the side of the leading edge 44 toward the side of the trailing edge 46.

The cooling passages adjacent to each other (for example, the cooling passage 60*a* and the cooling passage 60*b*) of the plurality of cooling passages 60 forming the serpentine flow passage 61 are connected to each other on the side of the tip 48 or the side of the base 50. In the connection part, a return flow passage with the flow direction of the cooling fluid being reversely folded in the blade height direction is formed, and the serpentine flow passage 61 has a serpentine shape in the radial direction as a whole. That is, the plurality of cooling passages 60 communicate with each other to form the serpentine flow passage 61.

The plurality of cooling passages 60 forming the serpentine flow passage 61 includes a most upstream passage positioned most upstream and a most downstream passage positioned on the most downstream side of the plurality of cooling passages 60. In the exemplary embodiments shown in FIGS. 2A to 3B, of the plurality of cooling passages 60, the cooling passage 60*a* positioned closest to the leading edge 44 is a most upstream passage 65, and the cooling passage 60*c* (FIGS. 2A and 2B) or the cooling passage 60*e* (FIGS. 3A and 3B) positioned closest to the trailing edge 46 is a most downstream passage 66.

In the turbine blade 40 including the serpentine flow passage 61 described above, the cooling fluid is introduced into, for example, the most upstream passage 65 of the serpentine flow passage 61 via the interior flow passage 84 formed inside the blade root portion 82 and an inlet opening 62 disposed on the side of the base 50 of the airfoil body 42 (see FIGS. 2A and 4A), and sequentially flows through the plurality of cooling passages 60 downward. Then, the cooling fluid flowing through the most downstream passage 66 on the most downstream side of the flow direction of the cooling fluid of the plurality of cooling passages 60 flows out to the combustion gas flow passage 28 external to the turbine blade 40 via an outlet opening 64 disposed on the side of the tip 48 of the airfoil body 42. The outlet opening 64 is an opening formed in the top board 49. The cooling fluid flowing through the most downstream passage 66 is partially discharged from the outlet opening 64. Providing the outlet opening 64, a stagnation space of the cooling fluid is generated in a space in the vicinity of the top board 49 of the most downstream passage 66, making it possible to prevent the inner wall surface 63 of the top board 49 from being heated.

The shape of the folded flow passage 61 is not limited to shapes shown in FIGS. 2A to 3B. For example, a plurality of folded flow passages may be formed inside the airfoil body 42 of the one turbine blade 40. Alternatively, the serpentine flow passage 61 may be branched into a plurality of flow passages at a branch point on the serpentine flow passage 61.

In some embodiments, as shown in FIGS. 2A and 3A, in a trailing edge part 47 (a part including the trailing edge 46) of the airfoil body 42, a plurality of cooling holes 70 are formed to be arranged along the blade height direction. The plurality of cooling holes 70 communicate with the cooling passage (the most downstream passage 66 of the serpentine flow passage 61 in the illustrated example) formed inside the airfoil body 42 and open to a surface in the trailing edge part 47 of the airfoil body 42.

The cooling fluid flowing through the cooling passage (the most downstream passage 66 of the serpentine flow passage 61 in the illustrated example) partially passes through the cooling holes 70 and flows out to the combustion gas flow passage 28 external to the turbine blade 40 from the opening in the trailing edge part 47 of the airfoil body 42. Since the cooling fluid thus passes through the cooling holes 70, convection-cooling of the trailing edge part 47 of the airfoil body 42 is performed.

The rib-shaped turbulators 34 are provided on at least some inner wall surfaces 63 of the plurality of cooling passages 60. In the exemplary embodiments shown in FIGS. 2A to 3B, the plurality of turbulators 34 are provided on the respective inner wall surfaces 63 of the plurality of cooling passages 60.

FIGS. 4 and 5 are schematic views for each describing the configuration of the turbulators 34 according to an embodiment. FIG. 4 is the schematic view of a partial cross-section along a plane including the blade height direction and a blade thickness direction (the circumferential direction of the rotor 8) of the turbine blade 40 shown in FIGS. 2A to 3B. FIG. 4 is the schematic view of a partial cross-section along a plane including the blade height direction and a blade width direction (the axial direction of the rotor 8) of the turbine blade 40 shown in FIGS. 2A to 3B.

As shown in FIG. 4, each of the turbulators 34 is disposed on the inner wall surface 63 of the cooling passage 60, and reference character "e" indicates a height of each of the turbulators 34 with reference to the inner wall surface 63. Moreover, as shown in FIGS. 4 and 5, in the cooling passage 60, the plurality of turbulators 34 are disposed at the interval of a pitch P. Furthermore, as shown in FIG. 5, an angle forming an acute angle (may also be referred to as an "inclination angle" hereinafter) between each of the turbulators 34 and a flow direction of the cooling fluid in the cooling passage 60 (an arrow LF in FIG. 5) is an inclination angle θ.

Providing the above-described turbulators 34 in the cooling passage 60, turbulence in the flow such as generation of vortex is promoted in the vicinity of the turbulators 34. That is, the cooling fluid flowing over the turbulators 34 forms a swirl between the adjacent turbulators 34 arranged downstream. Thus, in the vicinity of an intermediate position between the turbulators 34 adjacent to each other in the flow direction of the cooling fluid, the swirl of the cooling fluid adheres to the inner wall surface 63 of the cooling passage 60, making it possible to increase the heat-transfer coefficient between the cooling fluid and the airfoil body 42, and to effectively cool the turbine blade 40. However, a generation state of the swirl of the cooling fluid changes depending on the inclination angle of the turbulators 34, influencing the heat-transfer coefficient with the blade inner wall. Moreover, if the height of the turbulators is extremely high as compared with the pitch of the turbulators, the swirl may not adhere to the inner wall surface 63. Therefore, appropriate ranges exist between the heat-transfer coefficient and the inclination angle of the turbulators, and the heat-transfer coefficient and the ratio of the pitch and the height, as will be described later. Furthermore, extremely high turbulators may be the cause of an increase in pressure loss of the cooling fluid.

Each of FIGS. 6 to 10 and 12 is a schematic cross-sectional views of the rotor blade 26 (turbine blade 40) according to an embodiment. In addition, FIG. 11 is a schematic cross-sectional view of the stator vane 24 (turbine blade 40) according to an embodiment. Arrows in the drawings each indicate the flow direction of the cooling fluid.

The rotor blade 26 shown in FIGS. 6 to 10 and 12 has the same configuration as the above-described rotor blade 26.

Moreover, the serpentine flow passage 61 formed in the turbine blade 40 shown in FIGS. 6 to 12 is formed by the five cooling passages 60*a* to 60*e*. Of these cooling passages 60*a* to 60*e*, the cooling passage 60*a* positioned closest to the leading edge 44 is the most upstream passage 65, and the cooling passage 60*e* positioned closest to the trailing edge 46 is the most downstream passage 66.

Hereinafter, the configuration of the stator vane 24 (turbine blade 40) according to an embodiment will be described with reference to FIG. 11 before describing the characteristics of the turbulators 34 in the turbine blade 40 according to some embodiments with reference to FIGS. 2A to 3B and FIGS. 6 to 12.

As shown in FIG. 11, the stator vane 24 (turbine blade 40) according to an embodiment includes the airfoil body 42, an inner shroud 86 positioned radially inward with respect to the airfoil body 42, and an outer shroud 88 positioned radially outward with respect to the airfoil body 42. The outer shroud 88 is supported by the turbine casing 22 (see FIG. 1), and the stator vane 24 is supported by the turbine casing 22 via the outer shroud 88. The airfoil body 42 has an outer end 52 positioned on the side of the outer shroud 88 (that is, radially outward) and an inner end 54 positioned on the side of the inner shroud 86 (that is, radially inward).

The airfoil body 42 of the stator vane 24 has the leading edge 44 and the trailing edge 46 from the outer end 52 to the inner end 54. An airfoil surface of the airfoil body 42 has the pressure surface (concave surface) 56 and the suction surface (convex surface) 58 extending along the blade height direction between the outer end 52 and the inner end 54.

The serpentine flow passage 61 formed by the plurality of cooling passages 60 is formed inside the airfoil body 42 of the stator vane 24. The serpentine flow passage 61 has the same configuration as the serpentine flow passage 61 in the rotor blade 26 described above. In the exemplary embodiment shown in FIG. 11, the serpentine flow passage 61 is formed by the five cooling passages 60*a* to 60*e*.

In the stator vane 24 (turbine blade 40) shown in FIG. 11, the cooling fluid is introduced into the serpentine flow passage 61 via an interior flow passage (not shown) formed inside the outer shroud 88 and the inlet opening 62 disposed on the side of the outer end 52 of the airfoil body 42, and sequentially flows through the plurality of cooling passages 60 downward. Then, the cooling fluid flowing through the most downstream passage 66 on the most downstream side of the flow direction of the cooling fluid of the plurality of cooling passages 60 flows out to the combustion gas flow passage 28 external to the stator vane 24 (turbine blade 40) via the outlet opening 64 disposed on the side of the inner end 54 (on the side of the inner shroud 86) of the airfoil body 42, or discharged into the combustion gas from the cooling holes 70 of the trailing edge part 47 to be described later.

In the stator vane 24, the above-described turbulators 34 are provided on at least some inner wall surfaces of the plurality of cooling passages 60. In the exemplary embodiment shown in FIG. 11, the plurality of turbulators 34 are provided on the respective inner wall surfaces of the plurality of cooling passages 60.

In the stator vane 24, in the trailing edge part 47 of the airfoil body 42, the plurality of cooling holes 70 may be formed to be arranged in the blade height direction.

The characteristics of the turbulators 34 in the turbine blade 40 according to some embodiments will now be described with reference to FIGS. 2A to 3B and FIGS. 6 to 12.

In the turbine blade 40 shown in FIGS. 6 to 12, θa, θb, θc, θd, and θe are inclination angles of the turbulators 34 in the cooling passages 60*a* to 60*e*, respectively, Pa, Pb, Pc, Pd, and Pe are pitches of the adjacent turbulators 34 in the respective passages, namely, the cooling passages 60*a* to 60*e*, and ea, eb, ec, ed, and ee are heights (or average heights) of the adjacent turbulators 34 in the respective passages, respectively.

In the rotor blade 26 shown in FIG. 6, the inclination angles of the turbulators 34 in the cooling passages 60*a* to

60*e* satisfy θa=θb=θc=θd=θe (<90 degrees), and the pitches of the turbulators 34 in the cooling passages 60*a* to 60*e* satisfy Pa=Pb=Pc=Pd>Pe.

In the rotor blade 26 shown in FIG. 7, the inclination angles of the turbulators 34 in the cooling passages 60*a* to 60*e* satisfy θa (=90 degrees)>θb>θc>θd>θe, and the pitches of the turbulators 34 in the cooling passages 60*a* to 60*e* satisfy Pa=Pb=Pc=Pd>Pe.

In the rotor blade 26 shown in FIG. 8 and the stator vane 24 shown in FIG. 11, the inclination angles of the turbulators 34 in the cooling passages 60*a* to 60*e* satisfy θa=θb=θc=θd (=90 degrees)>θe, and the pitches of the turbulators 34 in the cooling passages 60*a* to 60*e* satisfy Pa=Pb=Pc=Pd>Pe.

In the rotor blade 26 shown in FIG. 9, the inclination angles of the turbulators 34 in the cooling passages 60*a* to 60*e* satisfy (90 degrees>) θb=θc>θd>θe, and the pitches of the turbulators 34 in the cooling passages 60*a* to 60*e* satisfy Pb=Pc=Pd>Pe.

In the rotor blade 26 shown in FIG. 10, the inclination angles of the turbulators 34 in the cooling passages 60*a* to 60*e* satisfy θb=θc (=90 degrees)>θd=θe, and the pitches of the turbulators 34 in the cooling passages 60*a* to 60*e* satisfy Pb=Pc=Pd>Pe.

Figure 12:
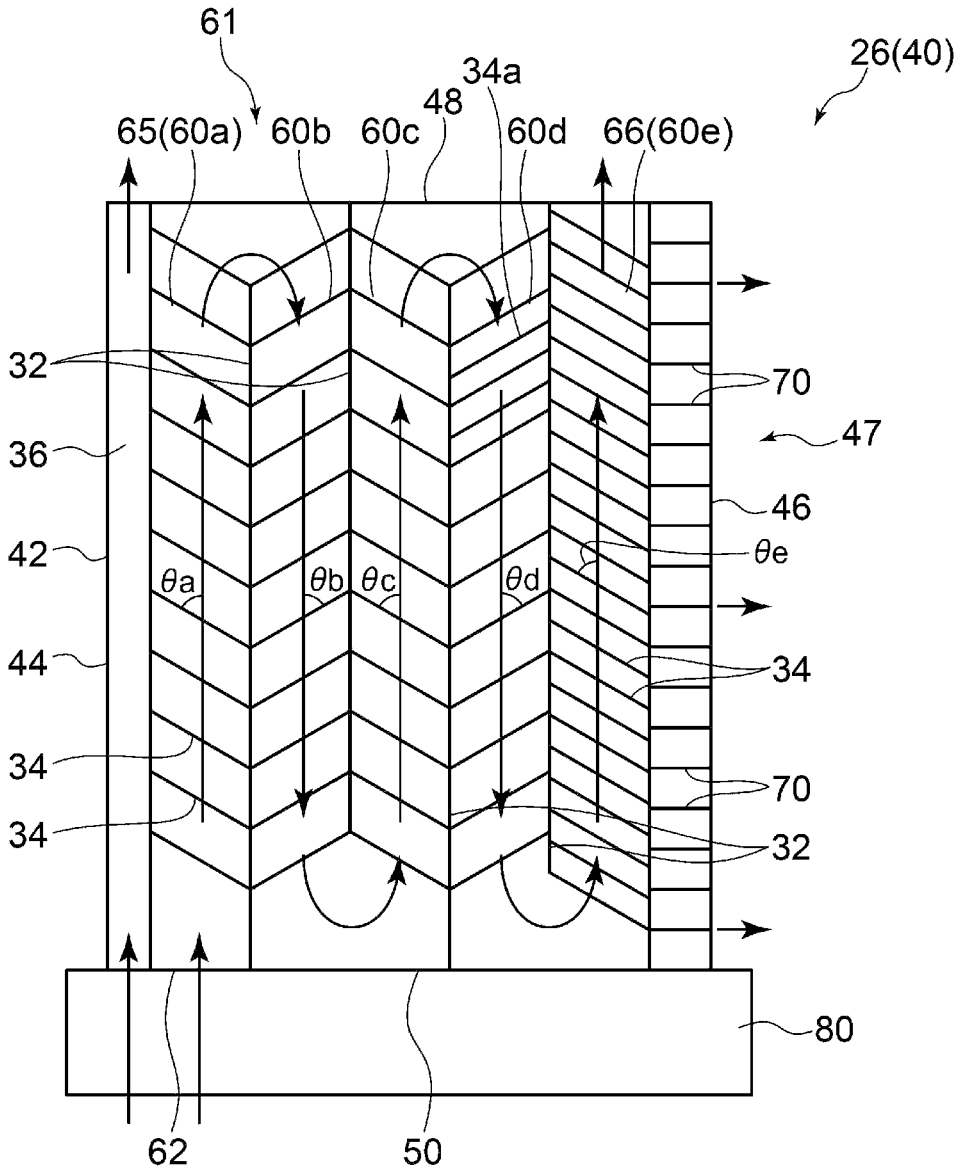
FIG. 12 is a schematic cross-sectional view of the rotor blade (turbine blade) according to an embodiment.

In the rotor blade 26 shown in FIG. 12, the inclination angles of the turbulators 34 in the cooling passages 60*a* to 60*e* satisfy θa=θb=θc=θd=θe (<90 degrees). The pitches of the turbulators 34 in the cooling passages 60*a* to 60*e* of the rotor blade 26 shown in FIG. 12 will be described later.

The cooling passage 60*a* of the rotor blade 26 shown in FIGS. 9 and 10 is not provided with the turbulator 34, and the inner wall surface of the cooling passage 60*a* is formed by the smooth surface.

In some embodiments, the rib-shaped first turbulators (turbulators 34) and the rib-shaped second turbulators (turbulators 34) are provided. The rib-shaped first turbulators (turbulators 34) are disposed on the inner wall surface of the upstream side passage of the plurality of cooling passages 60. The rib-shaped second turbulators (turbulators 34) are disposed on the inner wall surface of a downstream side passage of the plurality of cooling passages 60, the rib-shaped second turbulators (turbulators 34) being positioned on the downstream side of the upstream side passage in the serpentine flow passage 61. Then, second angles θ2 (inclination angles) formed by the second turbulators with respect to the flow direction of the cooling fluid in the downstream side passage are smaller than first angles θ1 (inclination angles) formed by the first turbulators with respect to the flow direction of the cooling fluid in the upstream side passage.

That is, the plurality of cooling passages 60 include the upstream side passage provided with the first turbulators having the inclination angles of the first angles θ1, and the downstream side passage provided with the second turbulators having the inclination angles of the second angles θ2 smaller than the first angles θ1.

The turbine blade 40 (the rotor blade 26 or the stator vane 24) shown in each of FIGS. 7 and 8, and FIGS. 9 to 11 is the turbine blade according to the present embodiment.

For example, in the rotor blade 26 shown in FIG. 8 and the stator vane 24 shown in FIG. 11, the inclination angles of the turbulators 34 in the cooling passages 60*a* to 60*e* satisfy θa=θb=θc=θd>θe. Thus, the cooling passages 60*a* to 60*d* in which the inclination angles of the turbulators 34 are θa to θd (first angles θ1) are the above-described upstream side passages, and the cooling passage 60*e* (that is, the most downstream passage 66) in which the inclination angle of the turbulators 34 is θe (second angle θ2) smaller than the first angles θ1 is the above-described downstream side passage.

Moreover, for example, in the rotor blade 26 shown in FIG. 9, the inclination angles of the turbulators 34 in the cooling passages 60*a* to 60*e* satisfy θb=θc>θd>θe. Thus, the cooling passage 60*b* in which the inclination angle of the turbulators 34 is θb (first angle θ1) is the above-described upstream side passage, and the cooling passages 60*d* and 60*e* in which the inclination angles of the turbulators 34 are θd and θe (second angles θ2) smaller than the first angle θ1 are the above-described downstream side passages. Likewise, provided that the cooling passage 60*c* is the upstream side passage with the inclination angle being the first angle θ1 (θc), the cooling passages 60*d* and 60*e* are the downstream side passages with the inclination angles being the second angles θ2 (<θ1). Moreover, likewise, provided that the cooling passage 60*d* is the upstream side passage in which the inclination angle is the first angle θ1 (θd), the cooling passage 60*e* is the downstream side passages in which the inclination angles are the second angles θ2 (<θ1).

Thus, the "upstream side passage" and the "downstream side passage" are to indicate the relative positional relationship between the two cooling passages 60 of the plurality of cooling passages 60.

FIG. 13 is a graph showing an example of a correlation between a heat-transfer coefficient ratio α and the inclination angle θ of the turbulators. Note that the heat-transfer coefficient ratio α is a ratio h/h0 of a heat-transfer coefficient h between the turbine blade and the cooling fluid in the cooling passage including the turbulators on the inner wall surface thereof to a heat-transfer coefficient h0 between the turbine blade and cooling fluid in the cooling passage without any turbulators therein and the inner wall surface thereof is formed by the smooth surface.

As shown in FIG. 13, in a range where the inclination angle θ of the turbulators 34 in the cooling passage 60 is less than 90 degrees, the heat-transfer coefficient ratio α between the cooling fluid and the turbine blade 40 tends to high as the inclination angle θ is small. The heat-transfer coefficient h0 when the inner wall surface of the cooling passage is formed by the smooth surface does not depend on the inclination angle of the turbulators 34 but is a constant. Therefore, the high heat-transfer coefficient ratio α (=h/h0) means that the heat-transfer coefficient h between the cooling fluid and the turbine blade 40 is high. That is, in the range where the inclination angle θ of the turbulators 34 in the cooling passage 60 is less than 90 degrees, the heat-transfer coefficient h between the cooling fluid and the turbine blade 40 tends to high as the inclination angle θ is small. On the other hand, as the inclination angle θ of the turbulators 34 increases, the pressure loss of the cooling fluid flowing through the passage decreases. Therefore, it is important to select the inclination angle θ of the turbulators 34 while balancing between the increase in the heat-transfer coefficient and the increase in the pressure loss obtained by decreasing the inclination angle θ. As shown in FIG. 13, in the inclination angle θ, an optimum angle at which the heat-transfer coefficient ratio α is the highest exists. The above-described inclination angle θ is referred to as an optimum angle (optimum value), for the sake of convenience. One example of the optimum angle is 60 degrees. Moreover, an inclination angle which is larger than the optimum angle and smaller than 90 degrees, and at which the heat-transfer coefficient is lower than the heat-transfer coefficient ratio α at the optimum angle is referred to as an intermediate angle (intermediate value).

In this regard, in the above-described embodiments, the inclination angles (second angles θ2) of the second turbulators in the downstream side passage are smaller than the inclination angles (first angles θ1) of the first turbulators in the upstream side passage of the serpentine flow passage 61. In this case, the optimum angle (optimum value) is selected for the inclination angles (second angles θ2) of the second turbulators, and the intermediate angle (intermediate value) is selected for the inclination angles (first angles θ1) of the first turbulators. Thus, the above-described heat-transfer coefficient h (or the heat-transfer coefficient ratio α) is relatively low in the upstream side passage, and cooling of the turbine blade 40 is suppressed, making it possible to maintain the temperature of the cooling fluid from the upstream side passage toward the downstream side passage relatively low. On the other hand, the above-described heat-transfer coefficient h (or the heat-transfer coefficient ratio α) is relatively high in the downstream side passage, and cooling of the turbine blade 40 is promoted, making it possible to enhance cooling of the turbine blade 40 in a downstream side region of the serpentine flow passage 61. Thus, it is possible to reduce the amount of the cooling fluid supplied to the serpentine flow passage 61 to cool the turbine blade 40, making it possible to improve thermal efficiency of the turbine 6.

In some embodiments, the average of the second angles θ2 of the plurality of second turbulators (turbulators 34) is smaller than the average of the first angles θ1 of the plurality of first turbulators (turbulators 34).

In this case as well, with the same reason described above, it is possible to maintain the temperature of the cooling fluid from the upstream side passage toward the downstream side passage relatively low, and to enhance cooling of the turbine blade 40 in the downstream side region of the serpentine flow passage 61. Thus, it is possible to reduce the amount of the cooling fluid supplied to the serpentine flow passage 61 to cool the turbine blade 40, making it possible to improve thermal efficiency of the turbine 6.

In some embodiments, for example, as shown in FIGS. 7, 8, 10, and 11, the turbine blade 40 includes the first turbulators (turbulators 34) disposed on the upstream side passage and having the first angle θ1 of 90 degrees.

That is, the cooling passage 60*a* in FIG. 7, one of the cooling passages 60*a* to 60*d* in FIG. 8, the cooling passage 60*b* or 60*c* in FIG. 10, or one of 60*a* to 60*d* in FIG. 11 may be the upstream side passage which includes the first turbulators (turbulators 34) having the first angle θ1 of 90 degrees, and at least the one cooling passage 60 positioned on the downstream side of the respective upstream side passages may be the downstream side passage.

As described above, in the range where the inclination angle θ of the turbulators 34 in the cooling passages 60 is 90 degrees or less than 90 degrees, the heat-transfer coefficient h (or the heat-transfer coefficient ratio α) between the cooling fluid and the turbine blade 40 tends to high as the inclination angle θ is small. In this regard, in the above-described embodiments, the inclination angles (first angles θ1) of the first turbulators in the upstream side passage is 90 degrees, and the inclination angles (second angles θ2) of the second turbulators in the downstream side passage is less than 90 degrees. Therefore, it is possible to maintain the temperature of the cooling fluid from the upstream side passage toward the downstream side passage relatively low, and to enhance cooling of the turbine blade 40 in the downstream side region of the serpentine flow passage 61. Thus, it is possible to reduce the amount of the cooling fluid supplied to the serpentine flow passage 61 to cool the turbine blade 40, making it possible to improve thermal efficiency of the gas turbine 1.

Herein, in the cooling passage 60, a ratio P/e of the pitch P of the adjacent pair of turbulators 34 (see FIGS. 4 and 5) to the height e of the turbulators 34 (or the average height e of the pair of turbulators 34) with reference to the inner wall surface 63 of the cooling passage 60 is defined as the shape factor.

In some embodiments, a second shape factor P2/e2 of the plurality of second turbulators (turbulators 34) disposed in the downstream side passage is smaller than a first shape factor P1/e1 of the plurality of first turbulators (turbulators 34) disposed in the upstream side passage.

Note that the first shape factor P1/e1 is the ratio P1/e1 of a pitch P1 of the adjacent pair of plurality of first turbulators (turbulators 34) to a height e1 of the first turbulators (or the average height e1 of the pair of first turbulators). Furthermore, the second shape factor P2/e2 is the ratio P2/e2 of a pitch P2 of the adjacent pair of plurality of second turbulators (turbulators 34) to a height e2 of the second turbulators (or the average height e2 of the pair of second turbulators).

The turbine blade 40 (the rotor blade 26 or the stator vane 24) shown in each of FIGS. 6 to 12 is the turbine blade according to the present embodiment.

For example, in the rotor blade 26 or the stator vane 24 shown in FIGS. 6 to 8 and FIG. 11, a shape factor Pe/ee in the cooling passage 60*e* is smaller than shape factors (Pa/ea to Pd/ed) in the cooling passages 60*a* to 60*d* positioned on the upstream side of the cooling passage 60*e*.

Alternatively, in the rotor blade 26 shown in FIGS. 9 and 10, the shape factor Pe/ee in the cooling passage 60*e* is smaller than the shape factors (Pb/eb to Pd/ed) in the cooling passages 60*b* to 60*d* positioned on the upstream side of the cooling passage 60*e*.

That is, the cooling passage 60*e* is the downstream side passage in which the shape factor of the turbulators 34 is the small second shape factor P2/e2 (Pe/ee), and the cooling passages 60*a* to 60*d* or the cooling passages 60*b* to 60*d* positioned on the upstream side of the downstream side passage (cooling passage 60*e*) and in which the shape factor of the turbulators 34 is the first shape factor P1/e1 (Pa/ea to Pd/ed or Pb/eb to Pd/ed) larger than the second shape factor P1/e2 are the upstream side passages.

FIG. 14 is a graph showing an example of a correlation between the heat-transfer coefficient ratio α and the shape factor P/e of the turbulators. Note that the heat-transfer coefficient ratio α is the ratio h/h0 of the heat-transfer coefficient h to the heat-transfer coefficient h0 described above.

As shown in FIG. 14, the heat-transfer coefficient ratio α between the cooling fluid and the turbine blade 40 is high, and the heat-transfer coefficient h between the cooling fluid and the turbine blade 40 tends to high, as the shape factor P/e of the turbulators 34 in the cooling passage 60 is small. On the other hand, the pressure loss of the cooling fluid flowing through the passage tends to increase as the shape factor P/e of the turbulators 34 is decreased. For example, if the pitch P is decreased without changing the height e of the turbulators, the shape factor P/e is decreased, but the pressure loss of the cooling fluid increases. Therefore, it is important to select the shape factor P/e of the turbulators 34 while balancing between the increase in the heat-transfer coefficient and the increase in the pressure loss obtained by decreasing the shape factor P/e. However, as shown in FIG. 14, the increase in the heat-transfer coefficient ratio α is limited, even if the shape factor P/e is decreased. An optimum shape factor having the highest heat-transfer coefficient ratio α is referred to as an optimum factor (optimum value), for the sake of convenience. Moreover, the shape factor P/e which is larger than the optimum factor and where the heat-transfer coefficient ratio α is lower than that of the shape factor P/e of the optimum factor is referred to as an intermediate factor (intermediate value).

In this regard, in the above-described embodiments, the first shape factor P1/e1 in the upstream side passage is larger than the second shape factor P2/e2 in the downstream passage. In this case, the optimum factor is selected for the shape factor (second shape factor) of the second turbulators, and the intermediate factor is selected for the shape factor (first shape factor) of the first turbulators. Thus, the above-described heat-transfer coefficient h (or the heat-transfer coefficient ratio α) is relatively low in the upstream side passage, and cooling of the turbine blade 40 is suppressed, making it possible to maintain the temperature of the cooling fluid from the upstream side passage toward the downstream side passage relatively low. On the other hand, the above-described heat-transfer coefficient h (or the heat-transfer coefficient ratio α) is relatively high in the downstream side passage, and cooling of the turbine blade 40 is promoted, making it possible to enhance cooling of the turbine blade 40 in a downstream side region of the serpentine flow passage 61. Thus, it is possible to reduce the amount of the cooling fluid supplied to the serpentine flow passage 61 to cool the turbine blade 40, making it possible to improve thermal efficiency of the gas turbine 1.

As described above, the shape factor P/e of the turbulators 34 is represented by the ratio P/e of the pitch P of the adjacent pair of turbulators 34 to the height e of the turbulators 34. Moreover, as shown in FIG. 14, the heat-transfer coefficient h (heat-transfer coefficient ratio α) changes if the shape factor P/e is changed. For example, the shape factor P/e is changed by changing the height e or the pitch P of the turbulators 34, making it possible to select the targeted heat-transfer coefficient h. The height e of the turbulators is related to the shape factor P/e, and is also related to a width D of the passage in the concave-convex direction (see FIG. 4). That is, the pressure loss of the cooling fluid flowing through the passage increases, if the height e of the turbulators 34 is extremely high relative to the width D in the concave-convex direction. In particular, the final passage (most downstream passage 66) has the small width D in the concave-convex direction, it is desirable that the height e of the turbulators 34 is less (lower) than the height e of the turbulators 34 in the upstream side passage. Selecting the appropriate height e of the turbulators 34, it is possible to reduce the pressure loss of the cooling fluid while maintaining the heat-transfer coefficient h.

In some embodiments, the downstream side passage includes the most downstream passage 66 positioned on the most downstream side of the flow of the cooling fluid of the plurality of cooling passages 60, and the upstream side passage includes the cooling passage 60 arranged adjacent to the most downstream passage 66.

For example, in the exemplary embodiments shown in FIGS. 6 to 10, the cooling passage 60*e* (most downstream passage 66) positioned on the most downstream side of the plurality of cooling passages 60 is the downstream side passage, and the upstream side passage includes the cooling passage 60*d* arranged adjacent to the cooling passage 60*e* (most downstream passage 66).

The cooling fluid which flows through the plurality of cooling passages 60 forming the serpentine flow passage 61 is heated up by a heat exchange with the turbine blade 40 to be cooled. The temperature of the cooling fluid increases downward and is the highest in the most downstream passage 66 positioned on the most downstream side of the flow direction of the cooling fluid.

In this regard, in the above-described embodiments, in the downstream side passage including the most downstream passage 66, the inclination angle of the turbulators 34 is smaller than in the upstream side passage, or the shape factor P/e of the turbulators 34 is smaller than in the upstream side passage. Thus, the above-described heat-transfer coefficient h (or the heat-transfer coefficient ratio α) is relatively low in the upstream side passage, and cooling of the turbine blade 40 is suppressed, making it possible to maintain the temperature of the cooling fluid from the upstream side passage toward the most downstream passage relatively low. On the other hand, the above-described heat-transfer coefficient h (or the heat-transfer coefficient ratio α) is relatively high in the most downstream passage, and cooling of the turbine blade 40 is promoted, making it possible to enhance cooling of the turbine blade 40 in the most downstream passage. Thus, it is possible to effectively reduce the amount of the cooling fluid supplied to the serpentine flow passage 61 to cool the turbine blade 40, and to improve thermal efficiency of the gas turbine 1.

For example, as shown in FIGS. 2A to 3B and FIGS. 6 to 12, the plurality of cooling passages 60 may include at least the three cooling passages 60.

Alternatively, for example, as shown in FIGS. 3A and 3B, and FIGS. 6 to 12, the plurality of cooling passages 60 may include at least the five cooling passages 60.

In this case, it is possible to make the inclination angles (second angles θ2) of the second turbulators in the downstream side passage of at least the three or five cooling passages 60 smaller than the inclination angles (first angles θ1) of the first turbulators in the upstream side passage of at least the three or five cooling passages 60 forming the serpentine flow passage 61. Alternatively, it is possible to make the shape factor P2/e2 of the second turbulators in the downstream side passage of at least the three or five cooling passages 60 smaller than the shape factor P1/e1 of the first turbulators in the upstream side passage.

Thus, it is possible to reduce the amount of the cooling fluid supplied to the serpentine flow passage 61 to cool the turbine blade 40, making it possible to improve thermal efficiency of the gas turbine 1.

Moreover, provided that at least the three or five cooling passages 60 form the serpentine flow passage 61, increasing the number of cooling passages 60, the cross-sectional areas of the respective cooling passages 60 are decreased. Thus, it is possible to increase the flow velocity of the cooling fluid, and to promote cooling of the turbine blade 40.

Moreover, provided that at least the three or five cooling passages 60 form the serpentine flow passage 61, increasing the number of cooling passages 60, the number of ribs 32 disposed between the adjacent cooling passages 60 is also increased. Thus, the surface area of the turbine blade 40 contacting the cooling fluid increases. Thus, it is possible to effectively decrease the average temperature in the cross-section of the turbine blade 40, and to reduce the amount of the cooling fluid since the tolerance of an average creep strength in the cross-section increases.

In some embodiments, for example, as shown in FIGS. 9 and 10, the inner wall surface of the most upstream passage 65 positioned on the most upstream side of the flow direction of the cooling fluid of the plurality of cooling passages 60 is formed by a smooth surface 67 which is not provided with any turbulators.

In a case in which the inner wall surface of the cooling passage 60 is formed by the smooth surface 67 which is not provided with any turbulators, the heat-transfer coefficient h=h0 (or the heat-transfer coefficient ratio $\alpha$=1) between the cooling fluid and the turbine blade 40 is low, as compared with a case in which the turbulators are provided on the inner wall surface of the cooling passage 60.

In this regard, in the above-described embodiments, since the inner wall surface of the most upstream passage 65 is formed by the smooth surface 67 which is not provided with any turbulators, the above-described heat-transfer coefficient h=h0 (or the heat-transfer coefficient ratio $\alpha$=1) in the most upstream passage 65 is lower than the above-described heat-transfer coefficient h (or the heat-transfer coefficient ratio $\alpha$) in the upstream side passage. That is, the above-described heat-transfer coefficient h (or the heat-transfer coefficient ratio $\alpha$) in the most upstream passage 65, the upstream side passage, and the downstream side passage forming the serpentine flow passage 61 increases in this order. Thus, the heat-transfer coefficient h (or the heat-transfer coefficient ratio $\alpha$) is easily changed in stages in the serpentine flow passage 61, facilitating adjustment of the cooling performance in each of the cooling passages 60.

In some embodiments, the downstream side passage includes the most downstream passage 66 positioned on the most downstream side of the flow direction of the cooling fluid of the plurality of cooling passages 60, and the most downstream passage 66 is formed such that the flow passage cross-sectional area thereof decreases toward the downstream side of the flow direction of the cooling fluid.

For example, in the exemplary embodiments shown in FIGS. 2A and 3A, the most downstream passage 66 is a downstream side passage having the smaller inclination angle $\theta$ or shape factor P/e of the turbulators 34 than the cooling passage 60 positioned on the upstream side of the most downstream passage 66. Then, the most downstream passage 66 is formed such that the flow passage cross-sectional area thereof decreases from upstream (the side of the base 50 (end part 1) of the airfoil body 42) toward downstream (the side of the tip 48 (end part 2) of the airfoil body 42) of the flow direction of the cooling fluid in the most downstream passage 66. Moreover, the cooling passage 60*d* which is an upstream side passage adjacent to the most downstream passage 66 and communicating with the most downstream passage 66 is formed such that the flow passage cross-sectional area thereof decreases from upstream (the side of the tip 48 of the airfoil body 42) toward downstream (the side of the base 50 of the airfoil body 42) of the flow direction of the cooling fluid.

In this case, since the most downstream passage 66 is formed such that the flow passage cross-sectional area thereof decreases toward the downstream side of the flow direction of the cooling fluid, the flow velocity of the cooling fluid increases toward downstream in the most downstream passage 66. Moreover, as with the most downstream passage 66, since the cooling passage 60*d* is formed such that the flow passage cross-sectional area thereof decreases toward the downstream side of the flow direction of the cooling fluid, the flow velocity of the cooling fluid increases toward downstream in the cooling passage 60*d*. Thus, it is possible to suppress an increase in the metal temperature of the blade inner wall on the side of the base 50 which is on the downstream side of the cooling passage 66*d*. Furthermore, since the most downstream passage 66 is formed such that the flow passage cross-sectional area thereof decreases toward the side of the tip 48 which is on the downstream side of the flow direction of the cooling fluid, the flow velocity of the cooling fluid increases, making it possible to efficiently cool the blade inner wall. As a result, the increase in the metal temperature of the blade inner wall of the most downstream passage 66 is suppressed, making it possible to improve cooling efficiency in the most downstream passage 66 where the temperature of the cooling fluid is relatively high. The above description is applied to the case of the blade configuration of FIG. 3A. However, the same description is also applicable to changes in the flow passage cross-sectional areas of the most downstream passage 66 and the cooling passage 60*b* in the blade configuration shown in FIG. 2A. Moreover, even in the case of the stator vane 26 shown in the schematic view of FIG. 11, the most downstream passage 66 may be formed such that the flow passage cross-sectional area thereof decreases from the outer end 52 (end part 1) thereof toward the inner end 54 (end part 2) thereof on the downstream side of the flow direction of the cooling fluid. As a result, the flow velocity of the cooling fluid increases, making it possible to suppress the increase in the metal temperature of the blade inner wall of the most downstream passage 66.

In some embodiments, the downstream side passage includes the most downstream passage 66 positioned on the most downstream side of the flow direction of the cooling fluid of the plurality of cooling passages 60, and the turbine blade 40 further includes a cooling fluid supply path 92 disposed so as to communicate with the upstream part of the most downstream passage 66 and configured to supply the cooling fluid from outside to the most downstream passage 66 (downstream side passage) without via the upstream side passage.

For example, in the exemplary embodiments shown in FIGS. 2A and 3A, the cooling fluid supply path 92 is disposed inside the blade root portion 82 so as to communicate with the upstream part (the side of the base 50 of the airfoil body 42) of the most downstream passage 66 which is the downstream side passage. Then, the cooling fluid from outside can be supplied to the most downstream passage 66 via the cooling fluid supply path 92 without via the upstream side passage (at least one of the cooling passages 60*a* to 60*d*) positioned on the upstream side of the most downstream passage 66.

In this case, in addition to the inflow of the cooling fluid from the upstream side passage of the serpentine flow passage 61 to the most downstream passage 66, the cooling fluid from outside is supplied to the most downstream passage 66 via the cooling fluid supply path 92, increasing the flow velocity of the cooling fluid flowing through the most downstream passage. Thus, it is possible to further enhance cooling in the most downstream passage 66 where the temperature of the cooling fluid from the upstream side passage of the serpentine flow passage 61 is relatively high.

The stator vane 24 (turbine blade 40) shown in FIG. 11 has the configuration (such as a magnitude relationship of the inclination angles $\theta$ or the shape factors P/e in the respective cooling passages 60) of the turbulators 34, which corresponds to that of the rotor blade 26 (turbine blade 40) shown in FIG. 8. However, the stator vane 24 (turbine blade 40) according to some embodiments may have the configuration corresponding to that of one of the rotor blades 26 (turbine blades 40) shown in FIGS. 6, 7, 9, 10, and 12.

In some embodiments, in the upstream side passage including the first turbulators, the first shape factors of some of the first turbulators are smaller than an average of the first shape factors of other of the first turbulators in the same passage.

As shown in FIG. 12, for the first shape factors of the first turbulators provided in the cooling passage 60*d* on the most downstream side of the upstream side passages, a factor which is smaller than an average value of the first shape factors of the other first turbulators in the same passage or the first shape factors of a plurality of other first turbulators is selected. For example, a hot spot occurs in a part in the same passage as the cooling passage 60*d* most downstream, and the metal temperature of the blade inner wall may locally be higher than that of another blade inner wall. In this case, for example, the pitch P is decreased without changing the height e of a turbulator 34*a* on the corresponding inner wall, decreasing the first shape factors P/e of the turbulators 34. That is, the first shape factors of the first turbulators on the inner wall of the passage where the hot spot occurs is made smaller than those in another part to increase the heat-transfer coefficient h, making it possible to partially enhance cooling. The example shown in FIG. 12 shows the example of the cooling passage 66*d*. However, the present invention is not limited to the present embodiment, and the example shown in FIG. 12 is also applicable to the other upstream side passage.

Embodiments of the present invention were described above, but the present invention is not limited thereto, and also includes an embodiment obtained by modifying the above-described embodiment and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "containing" or "having" one constitutional element is not an exclusive expression that excludes the presence of other constitutional elements.

REFERENCE SIGNS LIST

1 Gas turbine
2 Compressor
4 Combustor
6 Turbine
8 Rotor
10 Compressor casing
12 Air inlet
16 Stator vane
18 Rotor blade
20 Casing
22 Turbine casing
24 Stator vane
26 Rotor blade
28 Combustion gas flow passage
30 Exhaust chamber
32 Rib
34 Turbulator
35 Interior flow passage
36 Leading-edge side flow passage
40 Turbine blade
42 Airfoil body
44 Leading edge
46 Trailing edge
47 Trailing edge part
48 Tip
49 Top board
50 Base
52 Outer end
54 Inner end
60, 60*a* to 60*e* Cooling passage
61 serpentine flow passage
62 Inlet opening
63 Inner wall surface
64 Outlet opening
65 Most upstream passage
66 Most downstream passage (final passage)
67 Smooth surface
70 Cooling hole
80 Platform
82 Blade root portion
84 Interior flow passage
86 Inner shroud
88 Outer shroud
92 Cooling fluid supply path
P Pitch
e Height
θ Inclination angle

The invention claimed is:

1. A turbine blade, comprising:

an airfoil body; and a plurality of cooling passages extending along a blade height direction inside the airfoil body and being in communication with each other to define a serpentine flow passage, wherein:

each of the plurality of cooling passages is configured such that a cooling fluid flows in the cooling passage either from a tip side to a base side in the blade height direction or from the base side to the tip side in the blade height direction;

an adjacent two of the plurality of cooling passages are: (i) connected to each other via a connection part on an end portion of the tip side or the base side in the blade height direction; and (ii) configured such that the cooling fluid returns at the connection part toward an opposite direction in the blade height direction;

the plurality of cooling passages includes:

a downstream cooling passage positioned downstream with respect to a flow direction of the cooling fluid, the downstream cooling passage including an outlet opening at a tip of the airfoil body;

a plurality of upstream cooling passages positioned upstream of the downstream cooling passage with respect to the flow direction of the cooling fluid;

first turbulators on an inner wall surface of each of the plurality of upstream cooling passages; and second turbulators on an inner wall surface of the downstream cooling passage;

wherein:

a flow passage area of the downstream cooling passage decreases toward the outlet opening;

each of the first turbulators is positioned at a first angle which is in a direction orthogonal to the flow direction of the cooling fluid in each of the plurality of upstream cooling passages;

each of the second turbulators is positioned at a second angle which is an acute angle between each of the second turbulators and the flow direction of the cooling fluid in the downstream cooling passage, the plurality of cooling passages includes five cooling passages;

the downstream cooling passage is one of the five cooling passages; and the plurality of upstream cooling passages includes the other four of the five cooling passages.

2. The turbine blade according to claim 1, wherein a second shape factor defined by a height and a pitch of the second turbulators with respect to the flow direction of the cooling fluid in the downstream cooling passage is smaller than a first shape factor defined by a height and a pitch of the first turbulators with respect to the flow direction of the cooling fluid in each of the plurality of upstream cooling passages.

3. The turbine blade according to claim 2, wherein:

the first turbulators are arranged along the blade height direction;

the second turbulators are arranged along the blade height direction; and an average of the second shape factors is smaller than an average of the first shape factors.

4. The turbine blade according to claim 2, wherein the first shape factors of some of the first turbulators are smaller than an average of the first shape factors of others of the first turbulators in each of the plurality of upstream cooling passages.

5. The turbine blade according to claim 2, wherein:

the first shape factor is represented by a ratio P1/e1 of the pitch P1 of an adjacent pair of the first turbulators to the height e1 of the adjacent pair of the first turbulators with respect to the inner wall surface of each of the plurality of upstream cooling passages; and the second shape factor is represented by a ratio P2/e2 of the pitch P2 of an adjacent pair of the second turbulators to the height e2 of the adjacent pair of the second turbulators with respect to the inner wall surface of the downstream cooling passage.

6. The turbine blade according to claim 1, wherein:

the first turbulators are arranged along the blade height direction;

the second turbulators are arranged along the blade height direction; and an average of the second angles is smaller than an average of the first angles.

7. The turbine blade according to claim 1, wherein:

the cooling fluid is from a first supply of cooling fluid; and the turbine blade further comprises a cooling fluid supply passage configured to communicate with an upstream part of the downstream cooling passage and provide a second supply of cooling fluid from outside to the downstream cooling passage without the plurality of upstream cooling passages.

8. The turbine blade according to claim 1, wherein the turbine blade is a rotor blade for a gas turbine.

9. The turbine blade according to claim 1, wherein the turbine blade is a stator vane for a gas turbine.

10. A gas turbine, comprising:

the turbine blade according to claim 1; and a combustor for producing a combustion gas to flow through a combustion gas flow passage in which the turbine blade is disposed.

11. The turbine blade according to claim 1, wherein a flow passage area of one of the plurality of upstream cooling passages decreases toward a downstream side of the flow direction of the cooling fluid.

* * * * *